US006593695B2

(12) United States Patent
Theiss

(10) Patent No.: US 6,593,695 B2
(45) Date of Patent: Jul. 15, 2003

(54) BROADBAND, INVERTED SLOT MODE, COUPLED CAVITY CIRCUIT

(75) Inventor: Alan J. Theiss, Redwood City, CA (US)

(73) Assignee: Northrop Grumman Corp., Los Angeles, CA (US)

( * ) Notice: Subject to any disclaimer, the term of this patent is extended or adjusted under 35 U.S.C. 154(b) by 0 days.

(21) Appl. No.: 10/142,702

(22) Filed: May 8, 2002

(65) Prior Publication Data

US 2003/0030390 A1 Feb. 13, 2003

Related U.S. Application Data

(63) Continuation-in-part of application No. 09/231,058, filed on Jan. 14, 1999, now Pat. No. 6,417,622.

(51) Int. Cl.[7] ..... H01J 23/087

(52) U.S. Cl. ..... 315/3.5; 315/4; 315/5.35

(58) Field of Search ..... 315/3.5, 5, 5.35, 315/5.39, 5.41, 5.42, 4, 5.37; 313/309, 452, 414

(56) References Cited

U.S. PATENT DOCUMENTS

| | | | | |
|---|---|---|---|---|
| 2,966,610 A | | 12/1960 | Schmidt et al. | 315/3.5 |
| 3,011,085 A | | 11/1961 | Caldwell, Jr. | 315/3.5 |
| 3,309,630 A | | 3/1967 | Hukunaga | 315/3.5 |
| 3,668,460 A | | 6/1972 | James | 315/3.5 |
| 3,684,913 A | | 8/1972 | James et al. | 315/3.5 |
| 3,989,978 A | | 11/1976 | Sauseng et al. | 315/3.5 |
| 4,307,322 A | | 12/1981 | Chaffee et al. | 315/3.5 |
| 4,746,833 A | | 5/1988 | King et al. | 315/3.5 |
| 4,931,694 A | | 6/1990 | Symons et al. | 315/3.5 |
| 5,227,701 A | * | 7/1993 | McIntyre | 315/5.41 |
| 5,332,947 A | | 7/1994 | Theiss et al. | 315/3.5 |
| 5,448,133 A | | 9/1995 | Ise | 313/497 |
| 5,469,022 A | | 11/1995 | Begum et al. | 315/5.39 |
| 5,534,750 A | | 7/1996 | Theiss et al. | 315/5.35 |
| 5,604,399 A | | 2/1997 | Mandelman et al. | 313/512 |
| 5,965,971 A | | 10/1999 | Karpov | 313/309 |
| 6,023,126 A | | 2/2000 | Karpov | 313/310 |
| 6,294,868 B1 | * | 9/2001 | Imura et al. | 315/5 |
| 6,326,729 B1 | * | 12/2001 | Yokoo et al. | 315/5 |

OTHER PUBLICATIONS

"The Ground Station High–Power Traveling–Wave Tube" By Collier et al., The Bell System Technical Journal, Jul. 1963, pp. 1829–1861.

"A Coupled–Cavity TWT Operating In The Inverted Slot Mode" By Frey et al., IEEE, 1981, pp. 504–506.

"A BWO For 75 To 115 GHz" By Schneider et al. Siemens AG Bereich Röhren, München (Sep. 1970).

"Vergleich Von Verzögerungsleitungen Für Hochleistungs–Wanderfeldröhren" By Gross et al., Werk für Röhren der Siemens AG, München, pp. 61–66 (Date/Unknown).

* cited by examiner

*Primary Examiner*—Don Wong
*Assistant Examiner*—Jimmy T. Vu
(74) *Attorney, Agent, or Firm*—O'Melveny & Myers LLP

(57) ABSTRACT

A coupled cavity circuit for a microwave electron tube comprises at least two resonant cavities adjacent to each other. An electron beam tunnel passes through the coupled cavity circuit to allow a beam of electrons to pass through and interact with the electromagnetic energy in the cavities. An iris connecting the adjacent cavities allows electromagnetic energy to flow from one cavity to the next. The iris is shaped to cause the iris mode passband to be lower in frequency than the cavity mode passband while still providing broadband frequency response. In addition, the present coupled cavity circuit operates on an electron beam to interact with the third space harmonic of the second passband (the cavity passband) of the electromagnetic signal. Preferably, this interaction occurs on the second passband as this operational design provides output with higher frequencies without decreasing the cavity size. Furthermore, this operational design provides more frequencies with no increase to the iris size. This results in allowing higher power to be provided to the circuit without thermal degradation of the circuit. Also, because the interaction occurs on the third space harmonic of the second passband, the present operational design results in providing flatter frequency responses.

20 Claims, 19 Drawing Sheets

BROADBAND, INVERTED SLOT MODE, COUPLED CAVITY CIRCUIT

RELATED APPLICATION DATA

This is a continuation-in-part of application Ser. No. 09/231,058 filed Jan. 14, 1999 is now a U.S. Pat. No. 6,417,622, entitled Broadband, Inverted Slot Mode, Coupled Cavity Circuit.

BACKGROUND OF THE INVENTION

1. Field of the Invention

The present invention relates to microwave amplification tubes, such as a traveling wave tube (TWT) or klystron, and, more particularly, to a coupled cavity microwave electron tube that produces an inverted slot mode and a broadband response.

2. Description of Related Art

Microwave amplification tubes, such as TWT's or klystrons, are well known in the art. These devices are designed so that a radio frequency (RF) signal and an electron beam are made to interact in such a way as to amplify the power of the RF signal. A coupled cavity TWT typically includes a series of tuned cavities that are linked or coupled by irises (also know as notches or slots) formed between the cavities. A microwave RF signal induced into the tube propagates through the tube, passing through each of the respective coupled cavities. A typical coupled cavity TWT may have thirty or more individual cavities coupled in this manner. Thus, the TWT appears as a folded waveguide; the meandering path that the RF signal takes as it passes through the coupled cavities of the tube reduces the effective speed of the signal causing the electron beam to operate effectively upon the signal. Thus, the reduced velocity waveform produced by a coupled cavity tube of this type is known as a "slow wave."

Each of the cavities is linked further by an electron beam tunnel that extends the length of the tube and through which an electron beam is projected. The electron beam is guided by magnetic fields which are induced into the beam tunnel region; the folded waveguide guides the RF signal periodically back and forth across the drifting electron beam. Thus, the electron beam interacts with the RF signal as it travels through the tube to produce the desired amplification by transferring energy from the electron beam to the RF wave.

The magnetic fields that are induced into the tunnel region are obtained from flux lines that flow radially through polepieces from magnets lying outside the tube region. The polepiece is typically made of permanent magnetic material, which channels the magnetic flux to the beam tunnel. This type of electron beam focusing is known as Periodic Permanent Magnet (PPM) focusing.

Klystrons are similar to coupled cavity TWTs in that they can comprise a number of cavities through which an electron beam is projected. The klystron amplifies the modulation on the electron beam to produce a highly bunched beam containing an RF current. A klystron differs from a coupled cavity TWT in that the klystron cavities are not generally coupled. A portion of the klystron cavities may be coupled, however, so that more than one cavity can interact with the electron beam. This particular type of klystron is known as an extended interaction klystron (EIK).

For a coupled cavity circuit, the bandwidth over which the amplification of the resulting RF output signal occurs is typically controlled by altering the dimensions of the cavities and irises and the power of the RF output signal is typically controlled by altering the voltage and current characteristics of the electron beam. More specifically, for a coupled cavity circuit to propagate higher frequencies, the cavity size for the circuit has to be smaller. For a circuit to propagate more frequencies, the iris size has to be larger.

There are generally two frequency bands of interest in which propagation can occur. The lower frequency, first passband is referred to as the "cavity passband" because its characteristics are controlled largely by the cavity resonance condition. The higher frequency, second passband is referred to as the "iris passband" and its characteristics are controlled mainly by the iris resonance condition. Normally, the second space harmonic (between $\pi$ and $2\pi$ of the dispersion curve) of the first passband (or cavity passband) is used for interaction with the electron beam. As the length of the iris increases, the cavity resonance condition (usually appearing at the $2\pi$ point on the lower first passband of the dispersion curves) changes position with the iris resonance condition, which appears at the $2\pi$ point on the upper second passband. When this passband mode inversion occurs (i.e., cavity passband and iris passband trading relative positions), it provides the advantage of preventing drive-induced oscillations. Thus, no special oscillation suppression techniques are required. It should be noted that the mechanism of exciting the oscillations with a decelerating beam crossing a cavity resonance point is well known.

Unfortunately, to produce this passband mode inversion (also know as inverted slot mode), the iris length is usually to such an extent that it wraps around the electron beam tunnel. This has the disadvantage of introducing transverse magnetic fields when the iris lies in an iron polepiece. Furthermore, a significant problem with RF amplification tubes is the efficient removal of heat. As the electron beam drifts through the tube cavities, heat energy (resulting from stray electrons intercepting the tunnel walls) must be removed from the tube to prevent reluctance changes in the magnetic material, thermal deformation of the cavity surfaces, or melting of the tunnel wall. The excessive iris length and corresponding reduction in the amount of metal results in a longer heat flow path around the iris. Thus, the ability to remove heat is reduced significantly along with the overall coupled cavity circuit's thermal ruggedness.

Accordingly, it would be desirable to provide a coupled cavity circuit having an iris that produces the passband mode inversion without the excessive iris length. Also, it would be desirable for the coupled cavity circuit to have a broadband frequency response (i.e., many and higher frequencies) while preventing drive-induced oscillations so that no special oscillation suppression techniques are required. Furthermore, it would be desirable for such a coupled cavity circuit to offer a significant increase in the amount of metal provided around the electron beam tunnel such that a passband mode inversion occurs without an increase in transverse magnetic fields or degradation in thermal ruggedness.

In addition, a coupled cavity circuit that propagates higher and more frequencies at higher power would be advantageous. As mentioned, typically for a coupled cavity circuit to propagate higher frequencies, the cavity size for the circuit has to be smaller. Similarly, for a circuit to propagate more frequencies, the iris size has to be larger. But, for a coupled cavity circuit to increase output power, the cavity size must be larger and the iris size has to be smaller since a more thermally rugged circuit is needed to handle the higher power. A circuit having a larger cavity and a smaller iris is more thermally rugged.

Accordingly, for high power designs, it would also be desirable to provide a coupled cavity circuit that propagates higher frequencies without decreasing (or narrowing) the cavity size and propagates more frequencies without increasing the iris size. It would further be desirable for such a circuit to have outputs with flat frequency responses (i.e., less distortions).

SUMMARY OF THE INVENTION

In accordance with the teachings of the present invention, a coupled cavity circuit is provided with an iris that produces passband mode inversion such that the iris mode passband is at a lower frequency than the cavity mode passband. In addition, the coupled cavity circuit also provides broadband frequency response while preventing drive-induced oscillations so that no lossy material is required within the coupled cavity circuit. Furthermore, the coupled cavity circuit provides these advantages without requiring an excessive iris length and, thus, avoids any severe increase in transverse magnetic fields or degradation in thermal ruggedness.

In an embodiment of the present invention, a microwave electron tube, such as a traveling wave tube or an extended interaction klystron, comprises an electron gun for emitting an electron beam through an electron beam tunnel to a collector that collects the electrons from the electron beam. A slow wave structure is disposed along the electron beam path and defines an electromagnetic path along which an electromagnetic signal interacts with the electron beam. The slow wave structure has at least one coupled cavity circuit comprising at least one iris disposed between a first cavity and a second cavity for coupling the electromagnetic signal between the first cavity and the second cavity. The iris is disposed between the electron beam tunnel and a sidewall of the tube with the iris being symmetrical about a perpendicular axis of the electron beam tunnel. The iris has a center portion with a first width and flared ends with a second width that is greater than the first width. The flared ends wrap partially around the electron beam tunnel.

In a second embodiment of the present invention, the coupled cavity circuit of the slow wave structure has a rectangular shape. The iris has a rectangular central portion that extends substantially across one sidewall of the tube. The iris has flared ends that form a triangular region at each end of the central portion. The triangular regions have a hypotenuse that is adjacent to the electron beam tunnel and a side that extends part way along a sidewall of the tube that is adjacent to the one sidewall of the tube.

If there is more than one coupled cavity circuit, the irises can be in line, staggered, or on opposite sides of the tube. There can also be more than one iris per coupled cavity circuit with the irises in line or staggered from each other. The iris shape provides the inverted slot mode condition and broadband response without excessive iris length.

In a third embodiment of the present invention, a microwave electron tube is provided with an electron gun for emitting an electron beam having a predetermined voltage. The electron tube is also provided with a collector. The collector is spaced away from the electron gun. The collector is used for collecting electrons of the electron beam emitted from the electron gun. The tube is further provided with an interaction structure that defines an electromagnetic path along which an applied electromagnetic signal interacts with the electron beam. The interaction structure further comprises a plurality of cavity walls and a plurality of magnets. The plurality of cavity walls each has an aligned opening for providing an electron beam tunnel. The electron beam tunnel extends between the electron gun and the collector. The electron beam tunnel further defines an electron beam path for the electron beam. The magnets provide a magnetic flux path to the electron beam tunnel. The electromagnetic signal has a first passband and a second passband. The first passband has an upper bandedge. The second passband has first, second and third space harmonics and a lower bandedge. The interaction structure further includes respective cavities (defined therein) interconnected to provide a coupled cavity circuit. The plurality of cavity walls separating adjacent ones of the cavities. Each of the cavity walls also has an iris for coupling the electromagnetic signal therethrough. The iris and the cavity walls are dimensioned to allow the interaction structure to exhibit an inverted slot mode. The inverted slot mode comprises a cavity resonant frequency that is substantially larger than a corresponding iris cutoff frequency. The cavity resonant frequency is associated with the lower bandedge of the second passband. The iris cutoff frequency is associated with the upper bandedge of the first passband. In one embodiment, the predetermined voltage of the electron beam is determined to allow the electron beam to interact with the third space harmonic of the second passband. In another embodiment, the plurality of magnets comprise a plurality of permanent magnets. In a further embodiment, the iris and the cavity walls are dimensioned using a geometric formula to allow the interaction structure to exhibit the inverted slot mode. The geometric formula comprises:

$$\left(\frac{\pi^2 R^2 \ln(R/A)}{12L^2} + \frac{\pi R^2 Wm}{3GLT}\right) < 1$$

wherein A represents a radius of the beam tunnel; L represents an effective length of the iris; W represents a height of the iris; R represents a radius of one of the cavities that is coupled to the iris; T represents a thickness of one of the cavity walls that is associated with the iris; G represents a gap between two of the cavity walls; and m represents a fraction of a total current circulating in one of the cavities of the coupled circuit that intercepts only one iris. In yet another embodiment, the iris comprises an iris capacitance and an iris inductance. Each of the cavity walls comprises a cavity capacitance and a cavity inductance. The iris capacitance, the iris inductance, the cavity capacitance, and the cavity inductance are selected to exhibit the inverted slot mode.

In a fourth embodiment of the present invention. An applied microwave signal is amplified by interacting with an electron beam. The electron beam is focused by using a plurality of permanent magnets. The microwave signal has a first passband and a second passband. The first passband has a upper bandedge. The second passband has first, second and third space harmonics and a lower bandedge. A cavity resonant frequency that is substantially larger than a corresponding iris cutoff frequency is exhibited during the amplification of the microwave signal. The cavity resonant frequency is associated with the lower bandedge of the second passband. The iris cutoff frequency is associated with the upper bandedge of the first passband. The electron beam interacts with the microwave signal at the third space harmonic of the second passband.

A more complete understanding of the coupled cavity circuit will be afforded to those skilled in the art, as well as a realization of additional advantages and objects thereof, by a consideration of the following detailed description of the preferred embodiment. Reference will be made to the appended sheets of drawings that will first be described briefly.

DETAILED DESCRIPTION OF THE PREFERRED EMBODIMENT

The present invention satisfies the need for a coupled cavity circuit that provides passband mode inversion without requiring an excessive iris length. As a result, the coupled cavity circuit provides broadband response without introducing a severe increase in transverse magnetic fields or degradation in thermal ruggedness. Furthermore, the coupled cavity circuit prevents drive-induced oscillations and therefore no special oscillation suppression techniques such as lossy material is required in the circuit.

In addition, the present invention satisfies the need for a coupled cavity circuit to propagate RF signals at higher frequencies without decreasing the cavity size and more frequencies without increasing the iris size. As a result, higher power can be provided to the circuit without thermal degradation. In addition, the present invention also provides a coupled cavity circuit that outputs flatter frequency responses than the conventional coupled cavity circuit.

Figure 1:
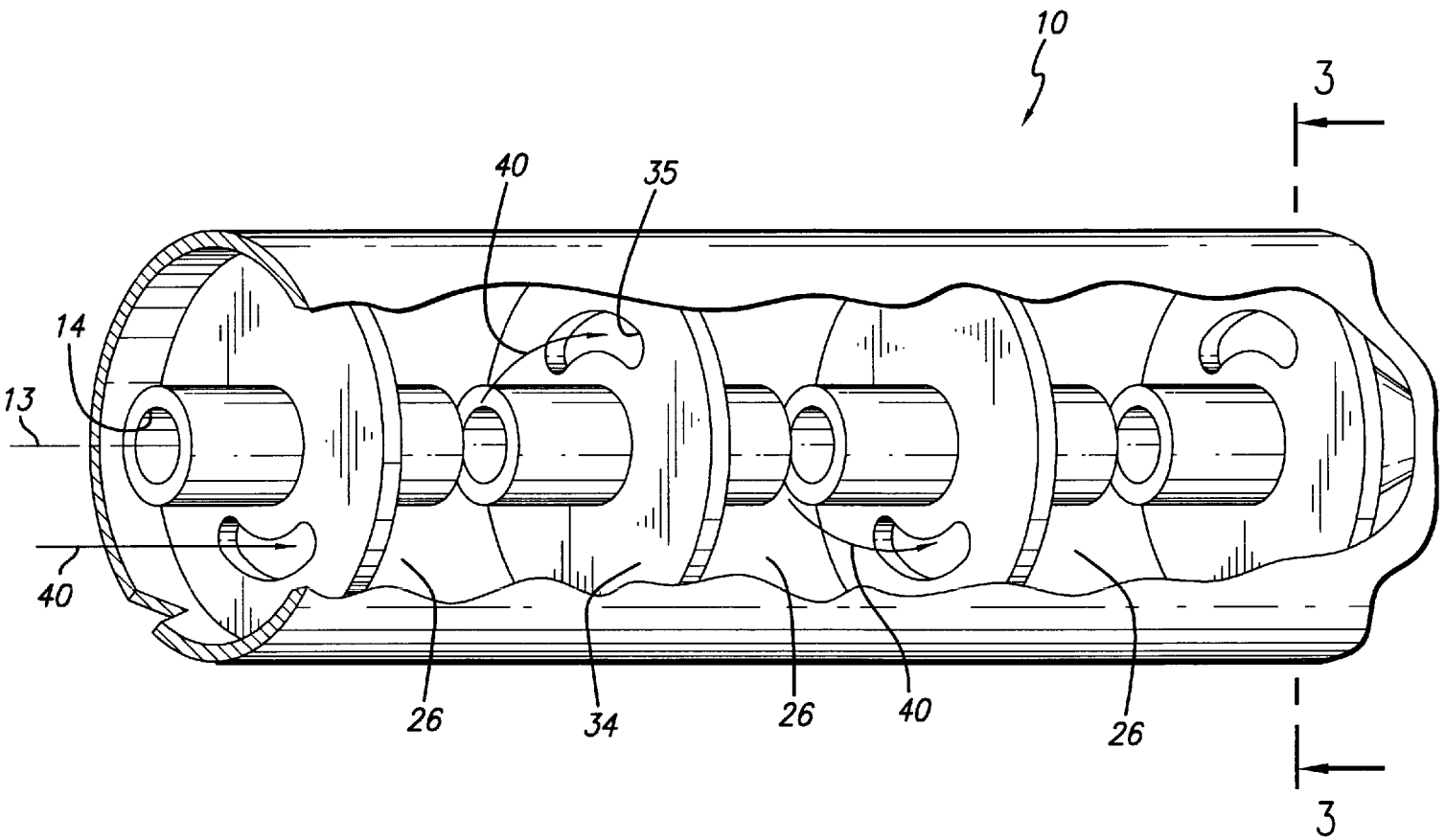
FIG. 1 PRIOR ART
FIG. 1 is a partial perspective view of a typical coupled cavity portion of a cylindrical microwave electron tube.

In the detailed description that follows, like element numerals are used to describe like elements illustrated in one or more of the figures. Referring first to FIG. 1, a typical coupled cavity cylindrical traveling wave tube 10 is shown. Because the coupled cavity section may be of any desired length, the coupled cavity TWT 10 is shown broken away from an input or output section of the TWT. In addition, although the coupled cavity TWT 10 is shown as being cylindrical in shape, it should be understood that the coupled cavity TWT 10 may alternatively be rectangular or any other shape, as known in the art. The coupled cavity structure includes a plurality of adjacent cavities 26 separated by polepieces 34. The polepieces 34 comprise disk shaped elements dividing the cylindrical shaped cavities 26. The cavities 26 are coupled by coupling irises (or slots) 35 that extend through a portion of each of the polepieces 34, thus providing a meandering path 40 for the traveling RF wave. An electron beam tunnel 14 extends along an axis of the TWT through a central portion of each polepiece 34 permitting passage of an electron beam 13 through each cavity 26.

Figure 2:
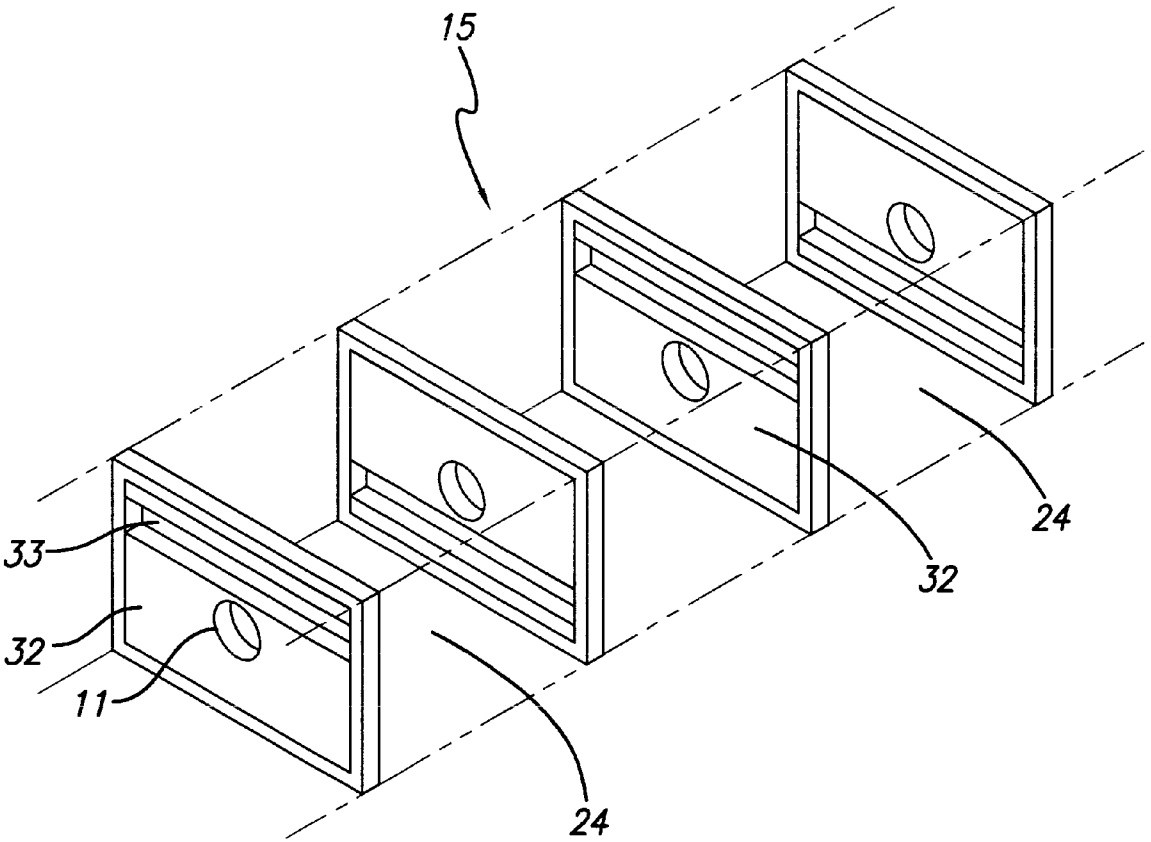
FIG. 2 PRIOR ART
FIG. 2 is a partial perspective view of a typical coupled cavity portion of a rectangular microwave electron tube.

FIG. 2 Illustrates a typical coupled cavity rectangular traveling wave tube 15 and, as with FIG. 1, is shown broken away from an input or output section of the TWT. The coupled cavity structure for the coupled cavity TWT 15 includes a plurality of adjacent cavities 24 separated by rectangular polepieces 32. The rectangular polepiece 32 has an iris (or slot) 33 and an electron beam tunnel 11. As seen in FIG. 2, the iris 33 is typically rectangular in shape to correspond with the rectangular shape of the coupled cavity TWT 15.

Figure 3A:
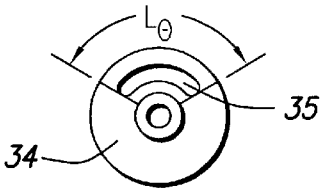
FIG. 3a PRIOR ART
FIGS. 3*a,* 3*b,* and 3*c* are cross-sectional views of a polepiece taken along line 3—3 of FIG. 1.
Figure 3B:
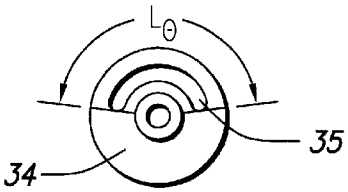
FIG. 3b PRIOR ART
Figure 3C:
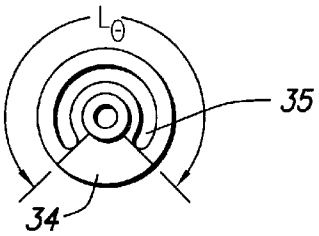
FIG. 3c PRIOR ART

Referring now to FIGS. 3*a*, 3*b*, and 3*c*: each figure shows a cross sectional view taken along line 2—2 of FIG. 1 of the polepiece 34. Above each polepiece 34, the respective length of the iris 35 is illustrated by Lθ where Lθ is the iris circumference length for a corresponding iris angle θ with origin centered at the electron beam tunnel. As discussed above, as the iris length Le varies, this changes the relative positions of the cavity mode passband and iris mode passband. This change in relative positions of the passbands is illustrated by the corresponding graphs of FIGS. 4*a*, 4*b*, and 4*c*. Specifically, FIGS. 4*a*, 4*b*, and 4*c* illustrate the coupled cavity circuit response for frequency (ω) versus the normalized wave number (wave number β times the circuit period P divided by π) generated by the respective iris length $L_\theta$ of FIGS. 3*a*, 3*b*, and 3*c*.

Figure 4A:
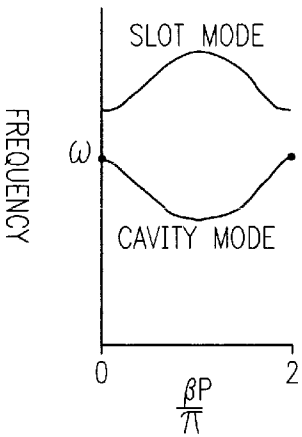
FIGS. 4*a,* 4*b,* and 4*c* are graphs illustrating the passband mode inversion that occurs as the iris length increases.
Figure 4B:
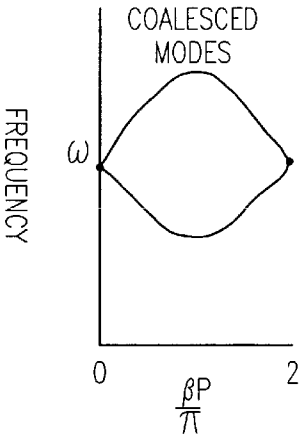

FIG. 3*a* illustrates the typical iris length $L_{74}$ and FIG. 4*a* illustrates the corresponding coupled cavity circuit operation for the iris length $L_\theta$ shown in FIG. 3*a*. As can be seen in the graph of FIG. 4*a*, the cavity mode passband is lower in frequency than the slot mode passband. In this configuration, the cavity mode passband is typically the passband used to interact with the electron beam. As the iris length $L_\theta$ increases, the cavity mode passband and slot mode passband migrate closer to each other until the two unite, as shown in FIG. 4*b* for the corresponding iris length $L_\theta$ of FIG. 3*b*. When the two modes merge, this condition is referred to as the coalesced mode.

Figure 4C:
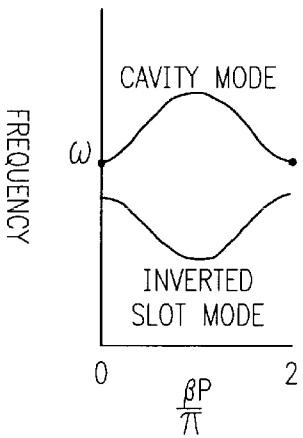

As the iris length continues to increase, the cavity mode passband becomes the upper, second frequency band and the slot mode passband becomes the lower, first frequency band, as shown in FIG. 4*c* for the corresponding iris length $L_\theta$ of FIG. 3*c*. This is referred to as inverted slot mode or passband mode inversion. Passband mode inversion allows the slot mode passband to function as the lower passband and the electron beam that previously would have interacted with the lower cavity passband now interacts with the lower slot mode passband. Furthermore, passband mode inversion prevents drive-induced oscillations because, for the slot mode passband, the interaction impedance of the electron beam at the upper cutoff frequency is zero due to the vanishing axial electric field component on the axis. Thus, in the inverted mode no special oscillation suppression techniques are required, such as lossy material placed within the coupled cavity circuit.

Notwithstanding these advantages, FIG. 3*c* shows that the iris length $L_\theta$ required to induce passband mode inversion is extensive. The iris within the polepiece wraps almost completely around the electron beam tunnel. This has the disadvantage of introducing transverse magnetic fields when the iris lies in an iron pole piece. In addition, due to current interception, heat is generated on the electron beam tunnel wall. Thus, the long iris length results in a longer heat flow path around the iris and, therefore, causes a decrease in the coupled cavity circuit's thermal ruggedness.

In the context of the present invention, certain conditions were derived for creating an inverted slot mode coupled cavity circuit having a short iris length. The geometry for obtaining a short-iris-inverted-slot-mode circuit follows from analysis of a Curnow cavity (one modeled by equivalent lumped elements). The generalized, two-slot cavity model 100 is shown schematically in FIGS. 5*a*–*b*.

Figure 5B:
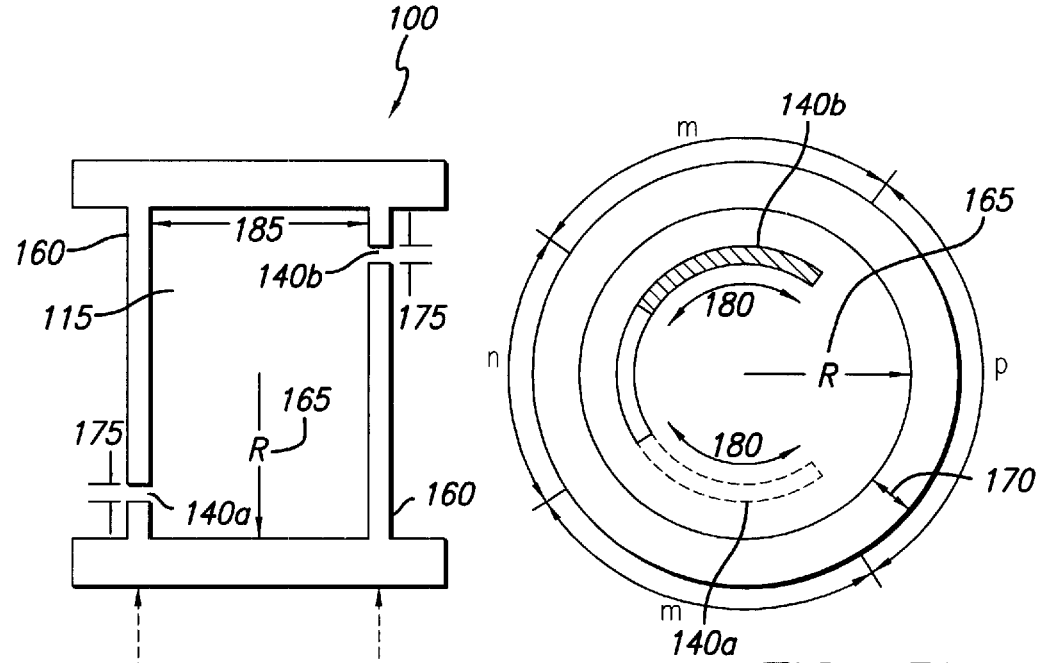
FIG. 5*b* is a back view of the model of FIG. 5*a;*
Figure 5A:
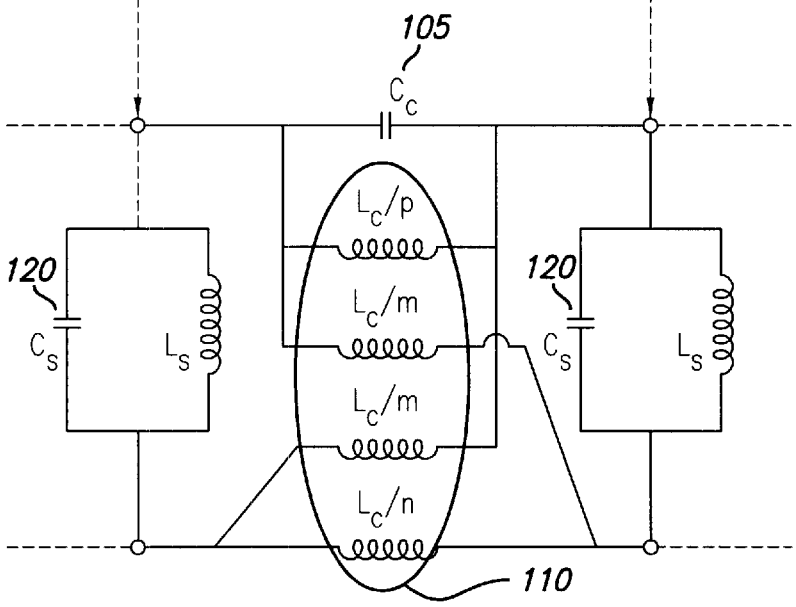
FIG. 5*a* is a schematic of a two-slot (or two-iris) cavity circuit model.

Referring now to FIGS. 5*a*–*b*, the generalized two-iris cavity circuit 100 can be described by various circuit parameters. The cavity parameter 105 comprises cavity capacitance $C_c$ and cavity inductances $L_c$. The cavity inductance $L_c$ is equal to inductances $L_c/m$, $L_c/n$, and $L_c/p$ 110. (When n=0, $L_c/n$ goes to infinity and $L_c$ equals $L_c/p$ and the two $L_c/m$'s because $L_c/p$ and the two $L_c/m$'s are connected in parallel.) The cavity capacitance $C_c$ and the cavity inductance $L_c$ are chosen so $\omega_c=(L_c, C_c)^{-1/2}$ becomes the angular resonant frequency of the cavity 115. The slot parameter 120 comprises slot capacitance $C_s$ and slot inductance $L_s$. The slot capacitance $C_s$ and the slot inductance $L_s$ are chosen so $\omega_s=(L_s, C_s)^{-1/2}$ becomes the angular resonant frequency of the iris 140*a* or 140*b*. Another three parameters denoted by m, n, and p are chosen such that p+2m+n=1, where m, p and n are the fractions of the total current circulating in the cavity circuit 110, intercepting respectively one iris (140*a* or 140*b*), no iris, and two irises (140*a* and 140*b*).

Additional parameters used for Curnow analysis are the phase shift per period θ, the total impedance $K=V_c^2/2P$, the cavity voltage $V_c$, the power flow along the circuit period, P, the impedance parameter $(R/Q)_c=(L_c/C_c)^{1/2}$ and twice the ratio of inductances a=2Ls/Lc.

In terms of the seven Curnow parameters, the phase shift and total impedance are given by:

$$\cos\theta = 1 - \frac{(1-\omega^2/\omega_c^2)(1+am-\omega^2/\omega_s^2)}{a[(m+n)^2 - n(1-\omega^2/\omega_c^2)]}, \text{ and}$$

$$k = -\frac{2(R/Q)_C(m+n)^2(\omega/\omega_c)(1+am-\omega^2/\omega_s^2)}{a\sin\theta((m+n)^2 - n(1-\omega^2/\omega^2c^2))}$$

In the context of the present staggered-slot embodiment of the invention, the length of the coupling irises (or slots) 140*a*–*b* are small. Thus, there is no current path that links two slots, so n=0. Accordingly, the above equations reduce to:

$$\cos\theta = 1 - \frac{(1-\omega^2/\omega_c^2)(1+am-\omega^2/\omega_s^2)}{am^2}$$

$$k = -\frac{2(R/Q)_C(\omega/\omega_c)(1+am-\omega^2/\omega_s^2)}{am^2\sin\theta}$$

At the cavity resonant frequency $w=w_C$, the phase shift per cavity is 2π, (cos θ=1), and the impedance goes to infinity because of the sine term. However, in both equations a group of three terms define a slot cutoff frequency $\omega_{SC}=\omega_S(1+am)^{1/2}$, which also occurs when cos θ=1 and for which the impedance is zero. If the slot cutoff frequency $\omega_{SC}$ can be made smaller than the cavity resonant frequency $\omega_C$, the first passband will be associated with the slot mode and the second with the cavity mode. This is the inverted slot mode condition.

Accordingly, the electrical condition for obtaining the small-iris, inverted-slot-mode circuit must be consistent with:

$$\frac{\omega_{SC}}{\omega_C} = \frac{\omega_S(1+am)^{\frac{1}{2}}}{\omega_C} < 1$$

or $$\frac{L_C C_C}{L_S C_S}(1+am) < 1.$$

Accordingly, by defining the following geometric parameters for the circuit 100 wherein:

R=radius 165 of equivalent cylindrical cavity 115,

A=radius of beam tunnel (inside radius of the tunnel),

T=polepiece (cavity wall 160) thickness 170,

G=gap 185 between cavity walls 160,

W=height of coupling iris 175,

L=effective length 180 of coupling iris (140*a* or *b*)

P=circuit period for a ferruless cavity (i.e., T+G) the following simple estimates of the geometric parameters for obtaining the small-iris, inverted-slot-mode circuit can be made (using the formula for a parallel-plate capacitor, the capacitance of a cylindrical cavity having no ferrules and a small tunnel can be approximated by the following equation):

$$C_C = \frac{\pi\varepsilon R^2}{6G}$$

where the factor 6 in the denominator accounts for the fall of the electric field towards the wall (wherein $\epsilon$ is the permittivity or ratio of electric displacement).

Thus, for a high power millimeter-wave frequency type design, where the ferrule is removed, the toroidal current flow inside the cavity leads to an estimate of a cavity inductance of:

$$L_C = \frac{\mu G}{2\pi}\ln(R/A)$$

(wherein $\mu$ is the magnetic permeability or ratio of magnetic flux). Using the fact that the resonant wavelength of the iris (or slot) is half the effective iris (or slot) length (wherein $f_S$ is the linear resonant slot frequency), $$L_S C_S = \left(\frac{1}{\omega_S}\right)^2 = \left(\frac{1}{2\pi f_S}\right)^2 = \left(\frac{\varepsilon\mu L}{\pi}\right)^2$$

and using a parallel-plate capacitor model for the coupling iris, $$C_S = \frac{\varepsilon L T}{W}$$

the slot (or iris) inductance is found to be $$L_S = \frac{\mu L W}{\pi^2 T}$$

The term (LcCc/LsCs)am can be simplified to 2mCc/Cs so the short-slot condition becomes $$\frac{L_C C_C}{L_S C_S}(1+am) = \frac{L_C C_C}{L_S C_S} + \frac{2_m C_C}{C_S} < 1$$

or $$\left(\frac{\pi^2 R^2 \ln(R/A)}{12L^2} + \frac{\pi R^2 Wm}{3GLT}\right) < 1$$

Thus, generally, to achieve the desirable geometry, the gap (G) between the cavity walls, the thickness of the cavity wall (T) and iris length (L) must be long while cavity radius (R) and iris height must be small (W). Accordingly, within the context of the present invention, an inverted slot mode can be achieved by increasing the cavity wall (T) or narrowing the iris height (W) (rather than by just extending the iris length (L)).

Figure 6B:
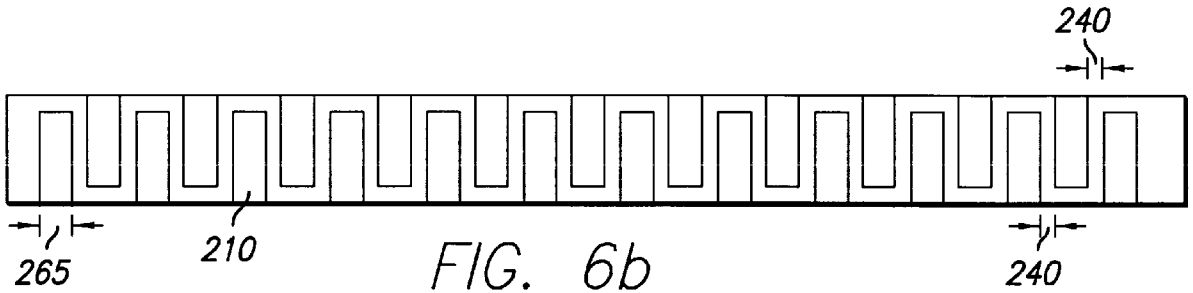
FIG. 6*b* is a side cross-sectional view of the interior of the coupled cavity circuit of FIG. 6*a;*
Figure 6A:
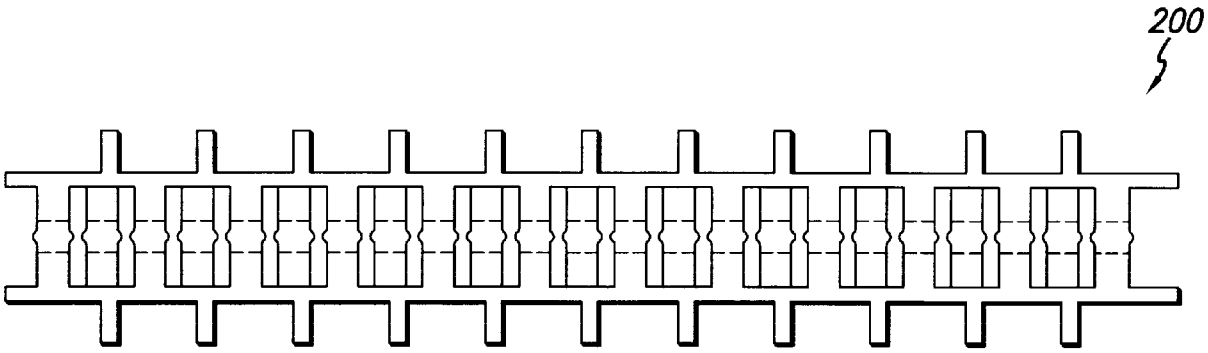
FIG. 6*a* is a top cross-sectional view of a coupled cavity circuit (e.g., a coupled cavity TWT amplifier) according to an embodiment of the present invention.
Figure 6C:
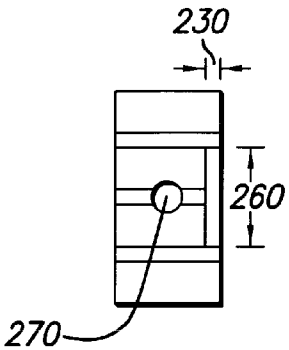
FIG. 6*c* is a back view of the coupled cavity circuit of FIG. 6*a;*

FIGS. 6*a–c* illustrate a TWT circuit 200 with most of the general features derived above. Especially notable are the thick cavity wall 210 in FIG. 6*b* (i.e., the wall thickness (T) 265), the short iris length 260 in FIG. 6*c* and the narrow iris height 230 in FIG. 6*c*. The geometric parameters for the TWT circuit 200 shown in FIGS. 6*a–c* can be derived by substituting certain geometric values into the above formula. In one embodiment, for the inverted slot mode to result, the left-hand term inside the brackets of the above geometric estimation formula equates to about 0.43 and the right-hand term to about 0.25 for a total of 0.68, which is less than 1. Accordingly, based on the above geometric estimation formula, the inverted slot mode condition can be met even though the gap (G) 240 between the cavity walls 210 and the iris length (L) 260 are small.

Because of the smaller iris length 260, the embodiment, shown in FIGS. 6*a–c,* produces passband mode inversion without the disadvantages discussed above. The shorter iris length 260 results in a shorter heat flow path out from the electron beam tunnel wall, and thus, the coupled cavity circuit's thermal ruggedness is increased. Furthermore, the shorter iris length reduces any significant increase in transverse magnetic fields when the iris lies in an iron polepiece.

In addition, the circuit 200 in FIGS. 6*a–c,* like most straight-walled ferruleless coupled-cavity circuits, is often called a rectangular folded-waveguide circuit (in contrast to the arched or serpentine type folded waveguides).

The selection of other geometric dimensions for a inverted slot mode circuit can also be derived by using the above geometric estimation formula. Preferably, after the geometry of the circuit has been estimated by the above formula, computer simulation codes (known to those skilled in the art), such as Magic3D, are used to confirm whether the cavity resonance is in the second passband.

Figure 7:
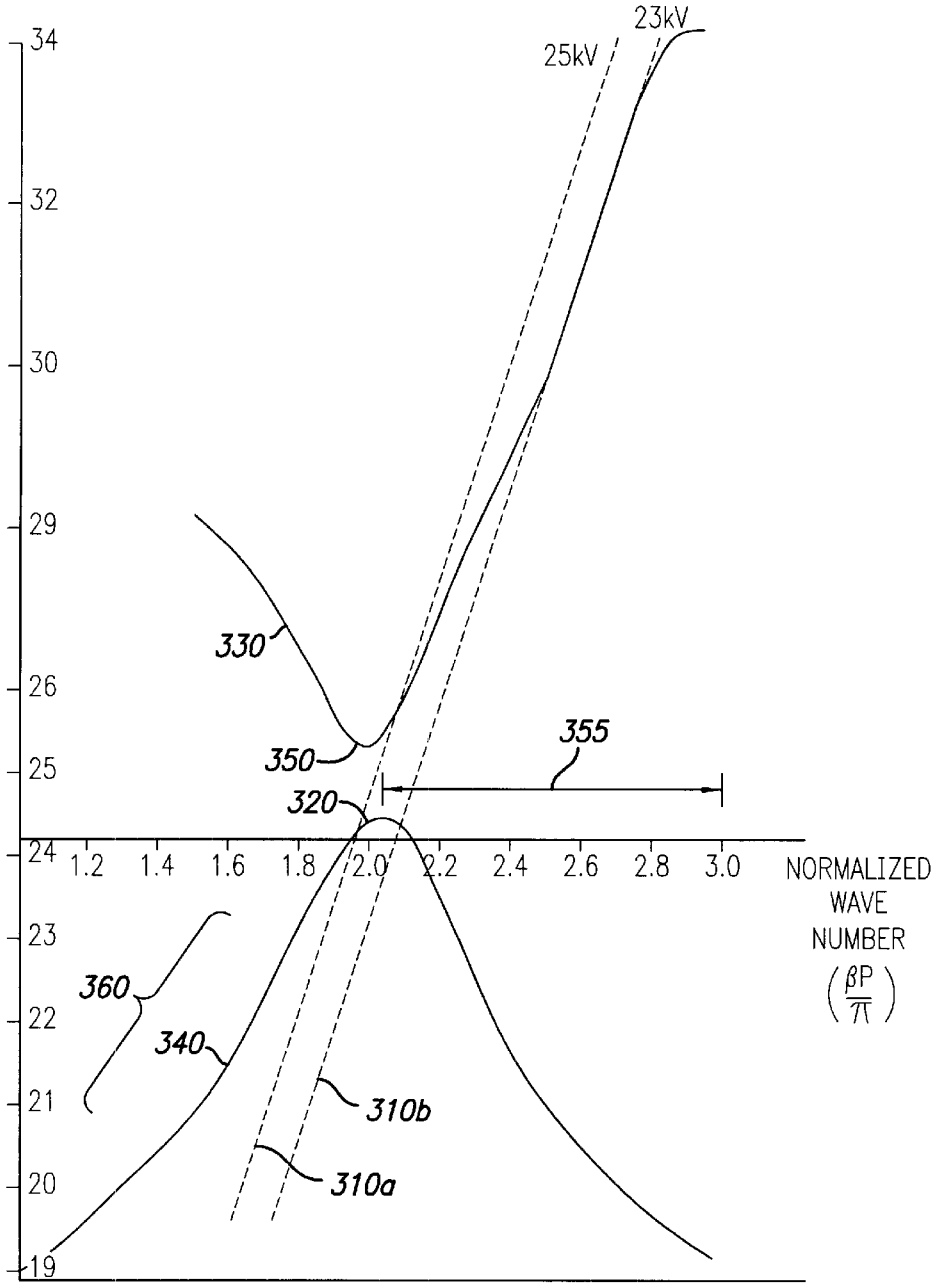
FIG. 7 is a graph plotting the frequency versus the wave number for the coupled cavity circuit of FIGS. 6*a–c* with interacting electron beam lines at the third space harmonic of the second passband.

FIG. 7 is a graph on the RF signal (i.e., electromagnetic signal or microwave) dispersions of the upper, second passband 330 and lower, first passband 340 of the circuit 200 in FIGS. 6*a–c*. The cavity resonance 350 is around 25.5 GHz at the bottom of the second passband 330. Conventionally, the first passband 340 is used to interact with electron beam lines. In the context of the present invention, however, it was discovered that it would be desirable to operate electron beams 310*a–b* to interact with the second passband 330. In addition, it was discovered that if the electron beam lines 310*a–b* are placed near the slot cutoff frequency 320, interaction with the second passband 330 can be achieved without significant interaction in the first passband 340. For example, in an operational embodiment of the present invention, a high-voltage electron beam 310*a* (25 kV) is utilized to interact with the third space harmonic in the second passband 330 of the inverted slot mode circuit 200 shown in FIGS. 6*a–c*. In this case, referring back to FIG. 7, the beam line crosses through the first passband 340 near the upper bandedge 320 where $\beta P/\pi=2$. At this point, the slot resonance stores circuit fields away from the cavity gap so no interaction will occur between the beam 310*a* and the first passband 340.

The main advantage of utilizing the third space harmonic 355 of the second passband 330 (in an inverted slot mode circuit) is its suitability for broadband, high-frequency, and high power designs. This is because the second passband 330 has larger bandwidth than the first passband when the coupling slot is small (in both length and height). The second passband 330 operation also yields either higher frequencies than the conventional first passband design at the same cavity size, or larger cavity sizes when the same frequencies are to be used. As mentioned, the larger cavity size is desirable for high power designs (e.g., circuits having larger cavities are more thermally rugged). Thus, a second passband operation allows for broadband high power (by allowing the use of larger cavity sizes) designs and/or broadband high frequency (by allowing the use of the same cavity size) designs.

An additional advantage to this type of circuit operational design is its ability to produce flat frequency responses since the slope of the dispersion in the third space harmonic of the second passband can easily lie parallel to the electron beam line (resulting in an output with flatter frequency responses). Accordingly, as shown in FIG. 7, when a 23 kV beam line 310*b* and a 25 kV beam line 310*a* are superimposed on the dispersion curve for the two passbands (330 and 340), the two electron beam lines 310*a–b*) align well with the slope of the second passband 330.

Thus, an operational design that utilizes a beam line that interacts with the third space harmonic in the second passband of an inverted slot mode circuit is desirable (instead of the conventional first passband operational interaction). Again, this second passband operational design is preferred because such an interaction will give amplification with flatter frequency responses at higher frequencies, broader bandwidth, and/or higher powers. In order to avoid the oscillation from power trapped in the first passband 340, impedance should be matched across both parts of the stopband in addition to matching along the frequencies of interest in the second passband 330.

Referring still to FIG. 7, to prevent significant oscillations with the cavity resonance 350 in the second passband at higher voltages (e.g., a beam line at 27.5 Kv) or with the backward wave 360 near the slot cutoff frequency 320 in the first passband at lower voltages (e.g., a beam line at 23.3 Kv), the electron beam line (310*a* or *b*) should be threaded through a region near the first passband 340 at $\beta P/\pi=2$ (i.e., by selecting the proper beam line voltage and current). Moreover, operation anywhere except exactly at $\beta P/\pi=2$ in the first passband 340, can result in some parasitic (unwanted) RF output in that passband 340.

Figure 8:
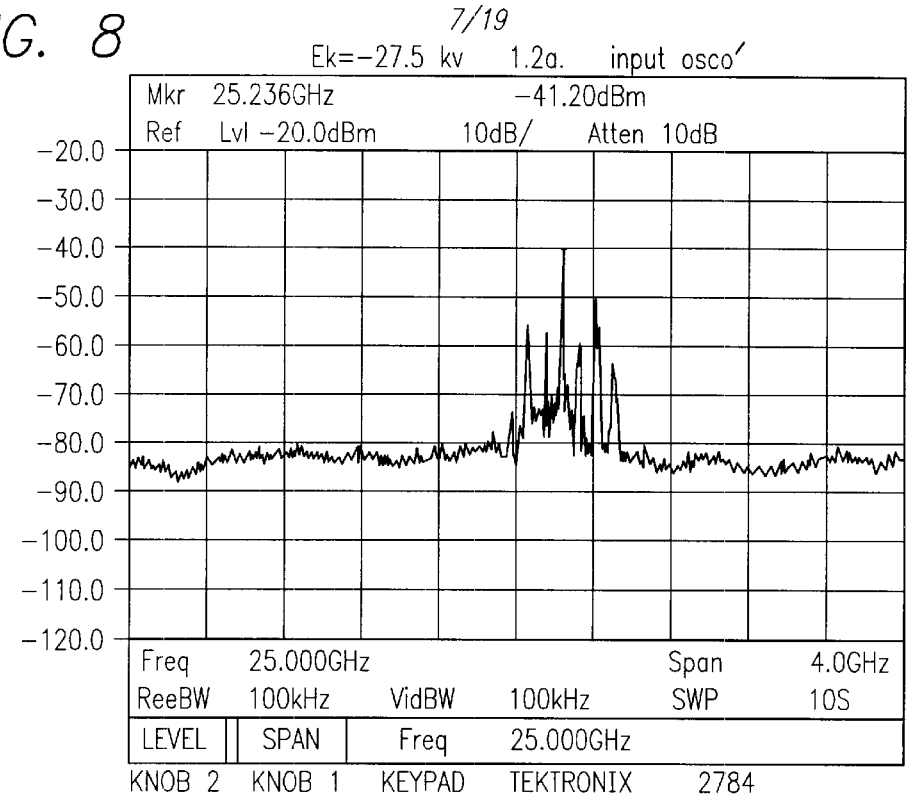
FIGS. 8 and 9 are graphs plotting two of the most common oscillations of the interactions shown in FIG. 7.
Figure 9:
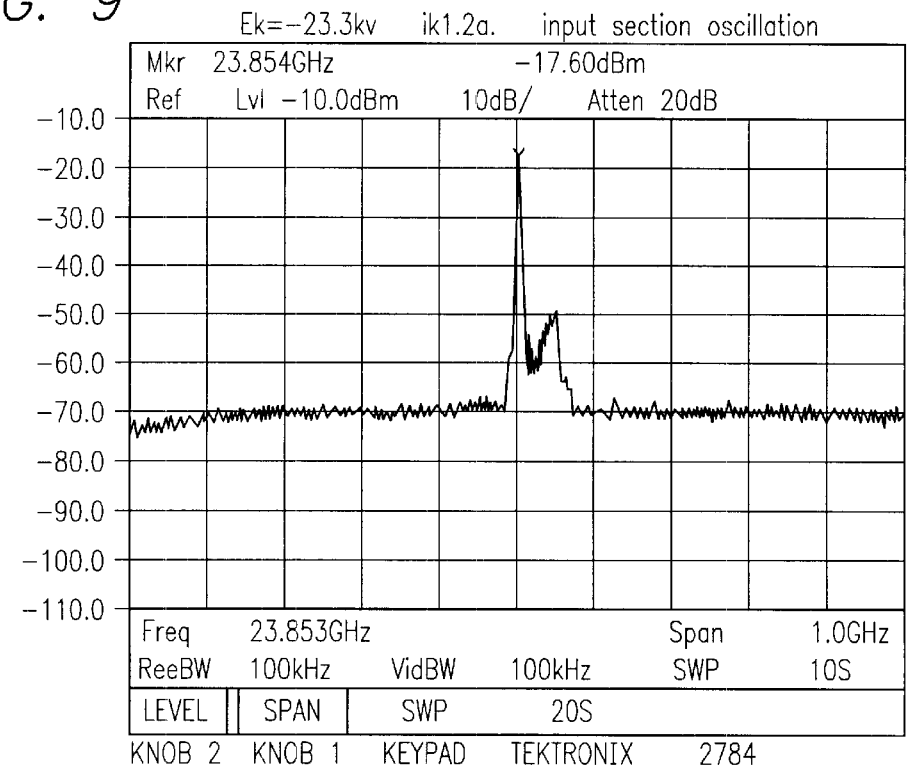
Figure 29:
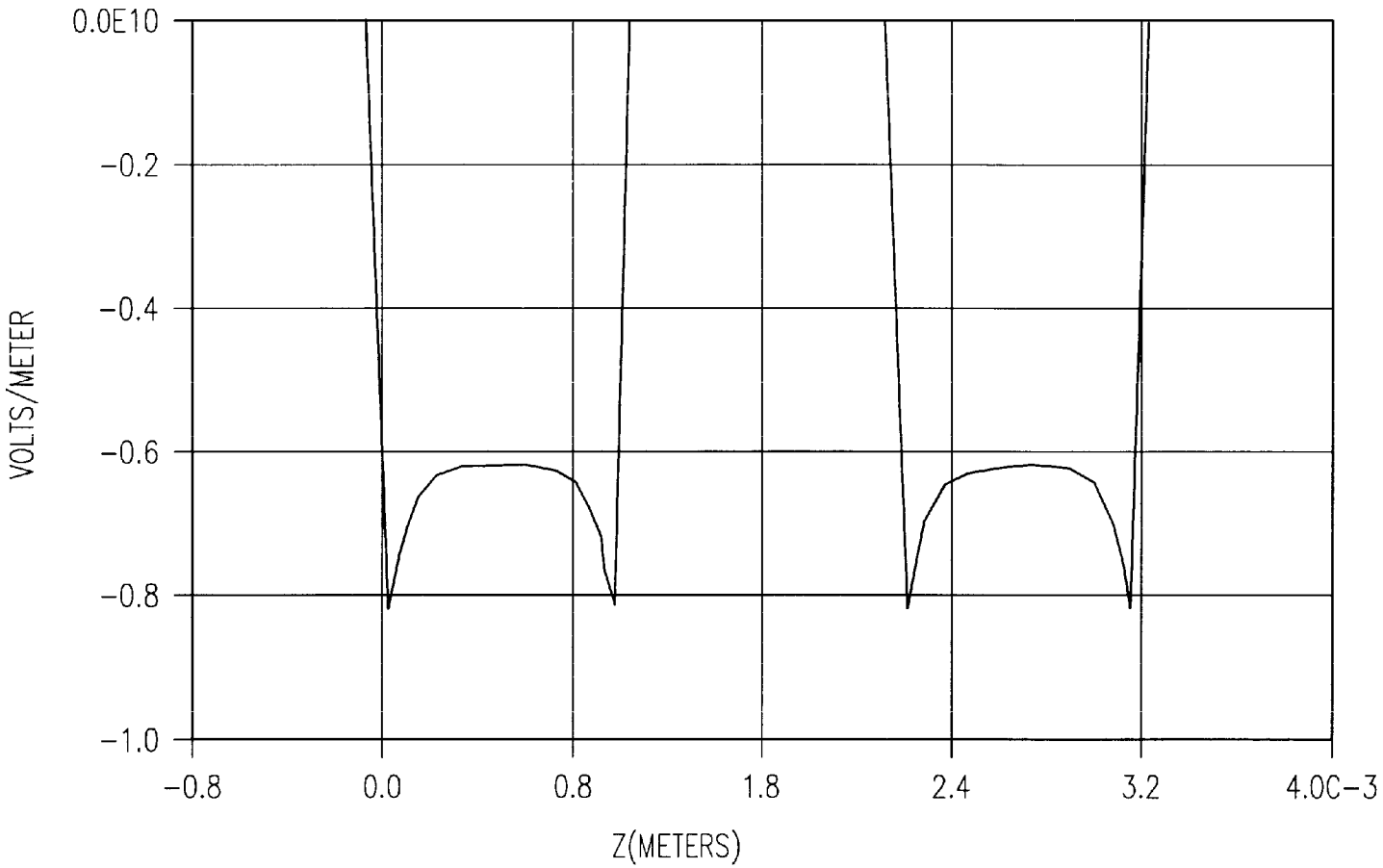
FIG. 29 is a graph illustrating the electric fields across the cavity gap at a cavity resonance frequency for a coupled cavity circuit that utilizes an iris according to an embodiment of the present invention.

For the circuit embodiment in FIGS. 6*a–c,* FIGS. 8 and 9 show the details of two of the most common oscillations. FIG. 8 shows that when the electron beam voltage was raised to above 25 Kv (i.e., 27.5 Kv), interaction with the cavity resonance around 25.3 GHz led to oscillation. FIG. 29 shows that when the beam voltage was decreased to below 24 Kv (i.e., 23.3 Kv), an oscillation occurs around 23.8 GHz, a frequency associated with backward wave oscillation (BWO) type interaction in the first passband. A summary of the stability regions for the circuit in FIGS. 6*a–c* (i.e., regions between the areas that will lend to oscillation) for beam voltages between 22 kV and 28.5 kV and for beam currents between 0.4A and 1.6A is shown by a plot in FIG. 10.

Figure 10:
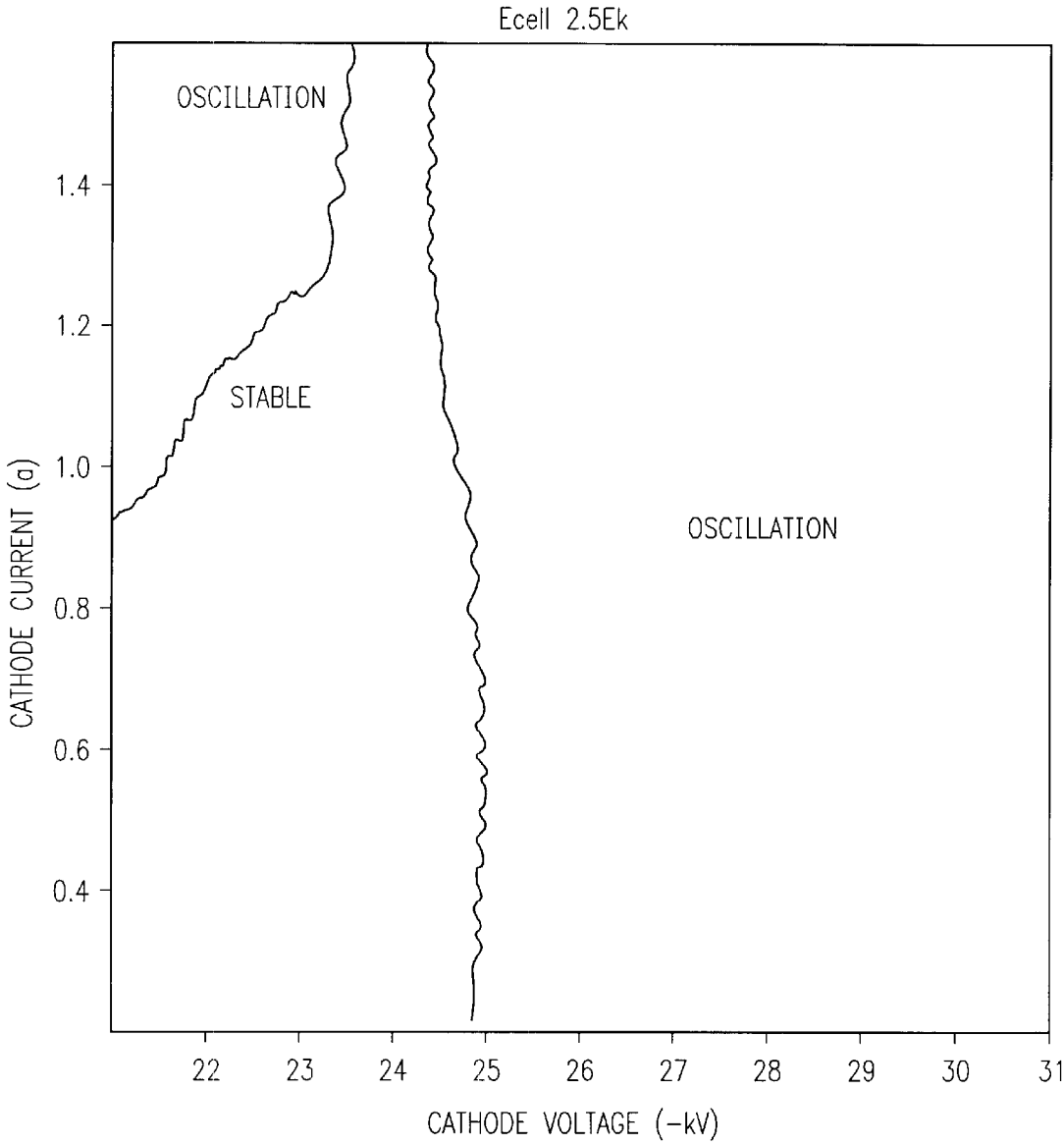
FIG. 10 is a voltage-versus-current graph that shows regions of stability (i.e., the regions of stability can be used to select an electron beam to interact with the third space harmonic in the second passband of an RF signal).

FIG. 10 shows a wide region of stability for low-voltage, low-current operation and a narrow region around 24.7 kV for higher beam currents that can be used to interact with the third space harmonic in the second passband. This narrow region becomes narrower as the current increases. This narrowing of the stability region results because when the beam line is positioned on top of the first passband, the slot resonance frequency becomes more exacting (unstable) as the beam current increases. The instability results from the fact that as the beam current is increased, there is a corresponding increase of the wavenumber range over which unstable interaction can occur.

Figure 11:
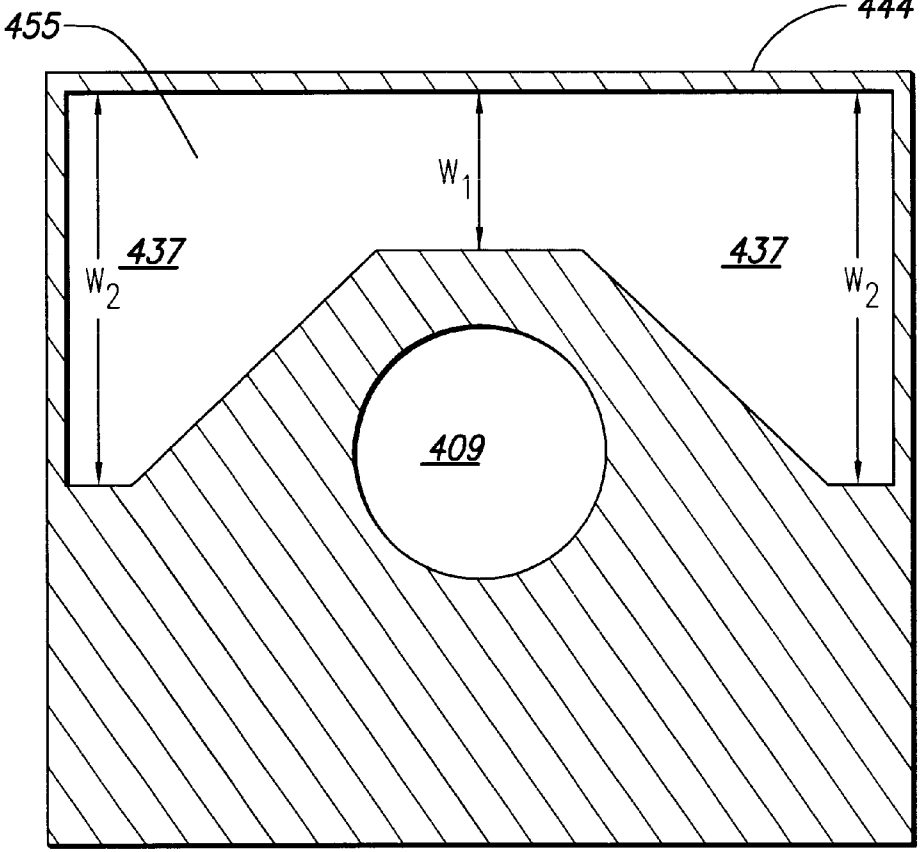
FIG. 11 is a cross-sectional view of a rectangular polepiece showing an iris according to an embodiment of the present invention.

Referring now to FIG. 11, a rectangular polepiece 444 for a coupled cavity circuit shows the iris 455 according to another embodiment of the present invention. The large triangular opening 437 with a width $W_2$, on each end of the iris 455, increases both the bandwidth and the impedance of the circuit. This results, as noted above, because a broader iris allows the propagation of a greater number of frequencies. The iris 455 has an iris center width $W_1$. The narrow separation of the iris center width $W_1$ increases the iris capacitance and thereby lowers the iris resonance frequency so that the coupled cavity circuit becomes stable in reference to drive-induced oscillations. Thus, the iris 455 induces passband mode inversion so that the iris mode passband is the first passband and the cavity mode passband is the second passband. Furthermore, the shape of the iris 455 induces the passband mode inversion without requiring the excessive iris length, such as illustrated in FIG. 3*c* for the prior art, and, thus, there is no severing of the magnetic flux from the periodic permanent magnet (PPM) focusing fields.

As can be seen in FIG. 11, the iris 455 according to an embodiment of the present invention has a much shorter iris length relative to the circumference of the electron beam tunnel 409 than in typical prior art irises such as illustrated in FIG. 3*c*. The iris 455 thus produces passband mode inversion without the disadvantages discussed above. The shorter iris length results in a shorter heat flow path out from the electron beam tunnel wall and, thus, the coupled cavity circuit's thermal ruggedness is increased. Furthermore, the shorter iris length reduces any significant increase in transverse magnetic fields when the iris lies in an iron polepiece.

Figure 12A:
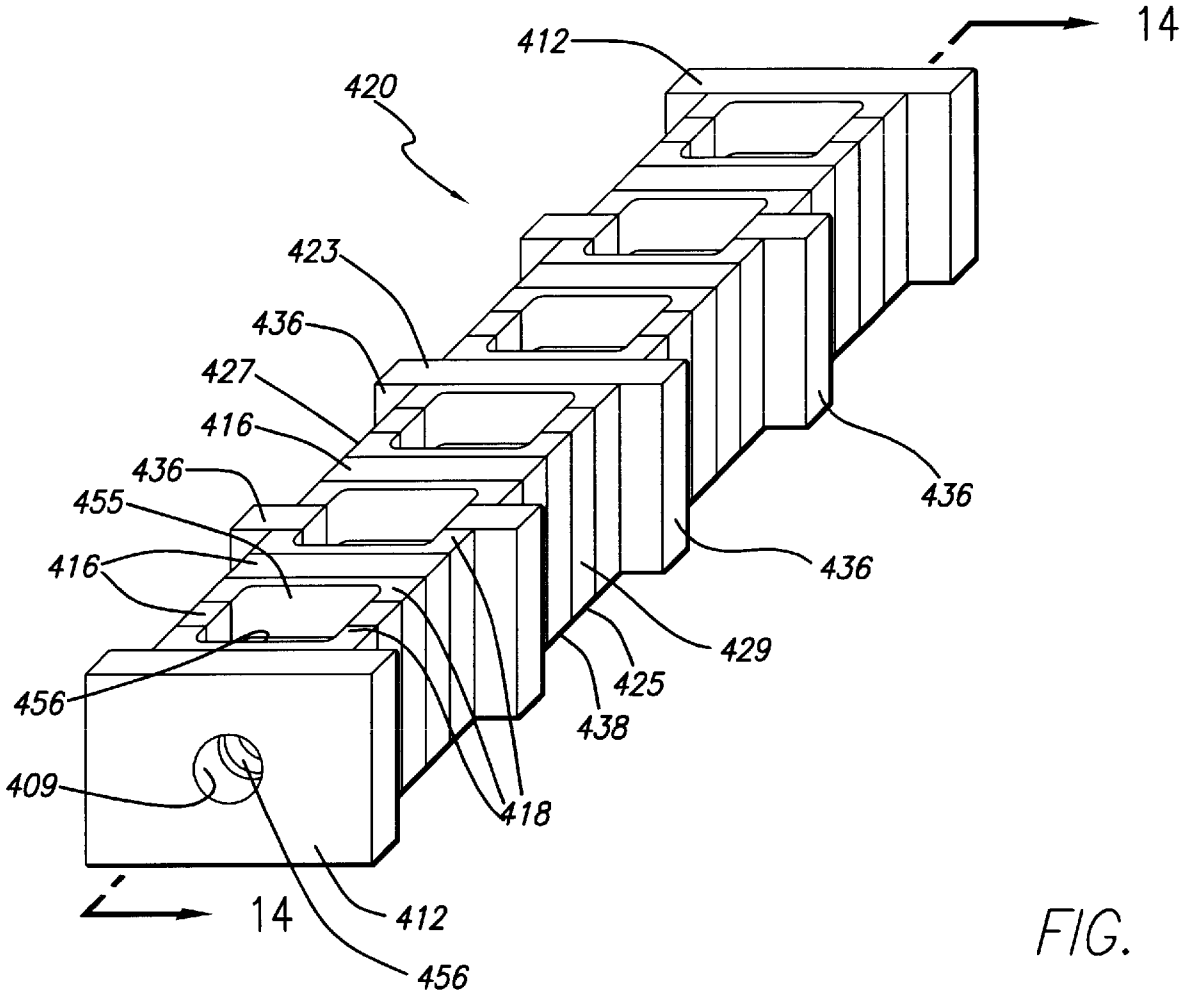
FIG. 12*a* is a perspective view of an integral polepiece RF amplification tube utilizing an iris according to an embodiment of the present invention.
Figure 12B:
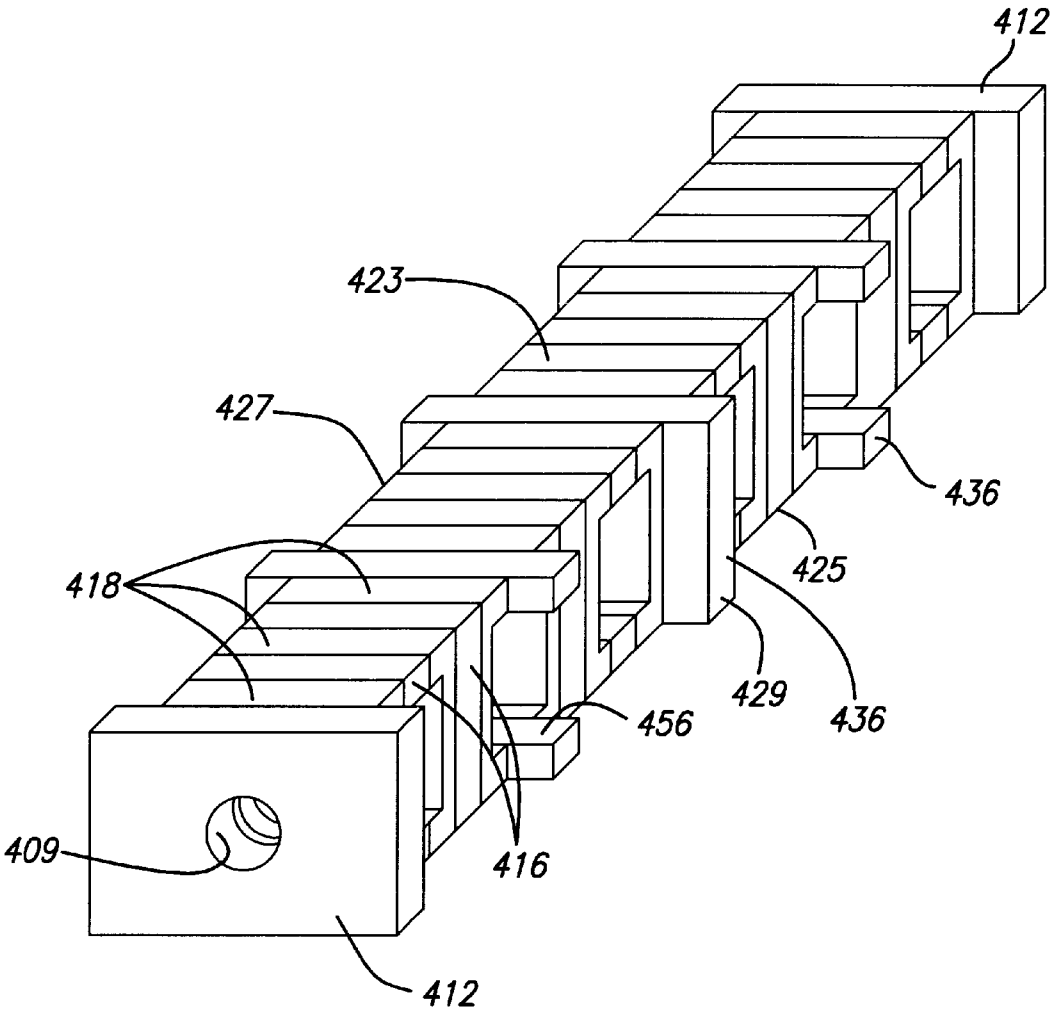
FIG. 12*b* is an alternative embodiment of an integral polepiece RF amplification tube.
Figure 13:
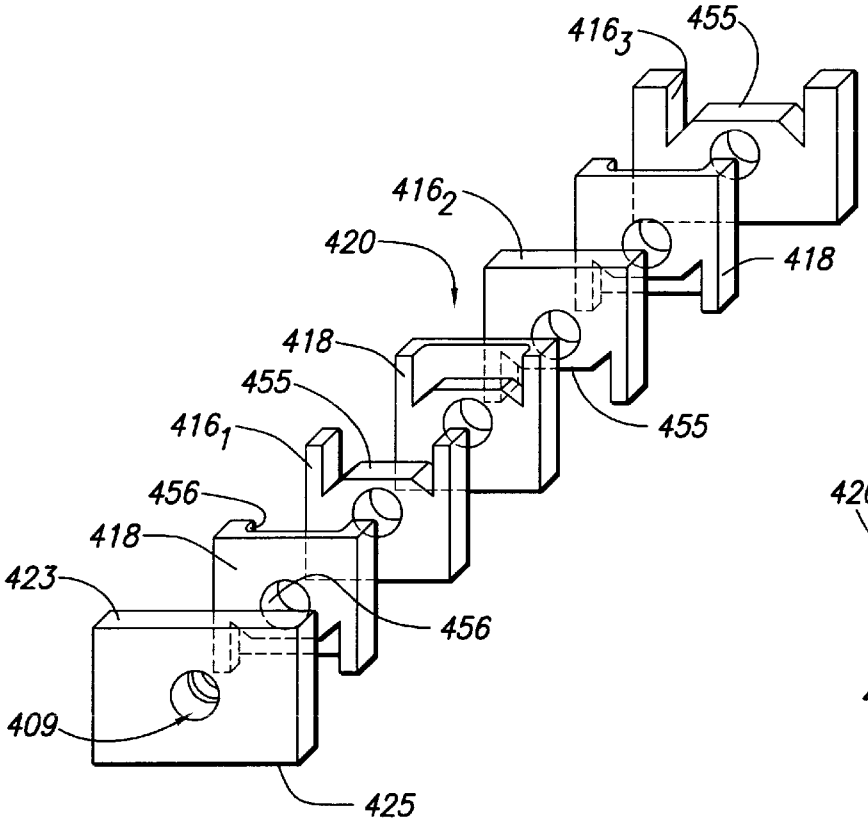
FIG. 13 is an exploded view of the integral polepiece RF amplification tube of FIG. 12*a;*

Referring now to FIGS. 12*a–b,* a perspective view of an integral polepiece RF amplification tube 420 is shown utilizing an iris in accordance with an embodiment of the present invention. The tube 420 comprises a plurality of non-magnetic plates 418 and magnetic plates 416 (also known as polepieces) which are alternatingly assembled and integrally formed together. The assembled tube 420 has end plates 412 disposed on either end and an electron beam tunnel 409 that extends through the end plates 412 and fully lengthwise through the tube 420. The tube 420 has a top 423 and a bottom 425 opposite the top 423 that provide a planar surface for attachment of a heat sink. The tube 420 has a one side 427 and a second side 429 opposite the one side 427 which are flush with edges of the non-magnetic plates 418 and the polepieces 416 except for individual ones of the polepieces 416 that extend outward from the one side 427 and the second side 429 to provide ears 436. The ears 436 provide a mounting position 438 for the installation of magnets (not shown). A more detailed description of integral polepiece RF amplification tubes is given in U.S. Pat. Nos. 5,332,947 and 5,534,750 and these are hereby incorporated by reference. FIG. 13 illustrates an exploded view of the integral polepiece RF amplification tube 420 of FIGS. 12*a–b*.

The polepieces 416 have an iris 455 (or slot or notch), according to an embodiment of the present invention, disposed at an edge. As best shown in FIG. 13, the position of the notch 455 in polepiece $\mathbf{416}_1$, appears at the top 423. The next polepiece $\mathbf{416}_2$ has a notch 455 disposed at the bottom 425. The third polepiece $\mathbf{416}_3$ would again feature the notch 455 at the top side 423, similar to that of polepiece $\mathbf{416}_1$. Alternatively, the notch positions could all remain on a single side (the one side 427 or the second side 429), top 423, or bottom 425 of the TWT 420, or could be a combination of the two configurations having a portion of the notches 455 disposed at the top 423 and a portion disposed on the bottom 425. Thus the notch 455 can be arranged in an in-line, staggered, alternating configuration, or any combination of the above or other geometric arrangement. In yet another embodiment, a single polepiece 416 could have more than one notch 455, such as one at both ends of the polepiece 416.

Figure 14:
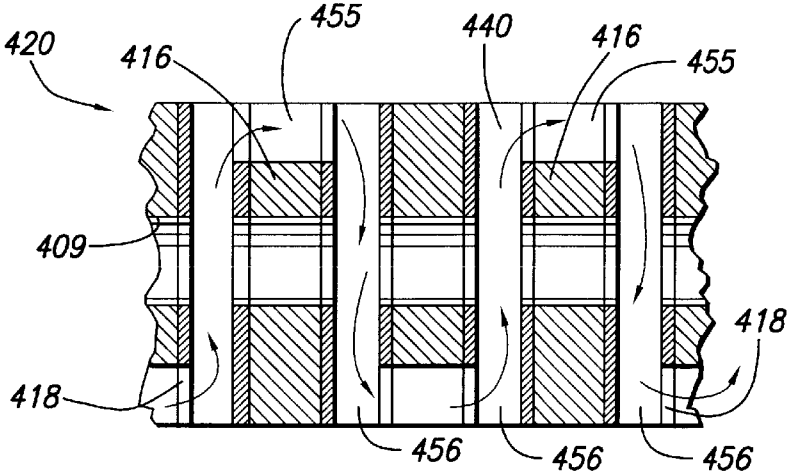
FIG. 14 is a cross-sectional view of the interior of the integral polepiece RF amplification tube, as taken through Section 14—14 of FIG. 12*a;*

The notches (or irises) 455 provide a coupling path for neighboring cavities 456 (see also FIG. 12*a*) formed in the non-magnetic plates 418 that are adjacently positioned relative to the polepieces 416 and alternate with the polepieces 416. The cavity 456 can be shaped, at each end, similar to notch 455 to aid in RF propagation and further the desired characteristics. Thus, a continuous path 440, visible in the sectional drawing of FIG. 14, through the tube 420 is provided that utilizes a notch (or iris) shape according to an embodiment of the present invention as in FIG. 11.

Alternatively, to vary the RF propagation characteristics, the cavity 456 could extend between the one side 427 and the second side 429 rather than the top 423 and the bottom 425 as shown in FIG. 12*b*. The cavity direction could also alternate between a first direction extending between the top 423 and the bottom 425 and a second direction extending between sides 427 and 429 (not shown). Additionally, it should also be apparent that cavities 456 could be provided in polepieces 416 as well as the non-magnetic plates 418 (not shown). Likewise, the notches 455 could be provided in the non-magnetic plates 418 as well as the polepieces 416 as desired to produce desired tube characteristics (not shown). Therefore, as indicated above, there are a large number of arrangements and layouts for the cavities 456 in relation to the notches 455 that are in accordance with an embodiment of the present invention for the coupled cavity circuit.

It should also be understood that there are many variations of the iris 455 of FIG. 11 that are in accordance with embodiments of the present invention that would provide the required capacitive and inductive loading of the iris 455, the cavities 456, and the polepieces 416 in order to invert the cavity mode and slot mode passbands (e.g., iris 220 shown in FIG. 6*c*).

Figures 15A, 15B, 15C:
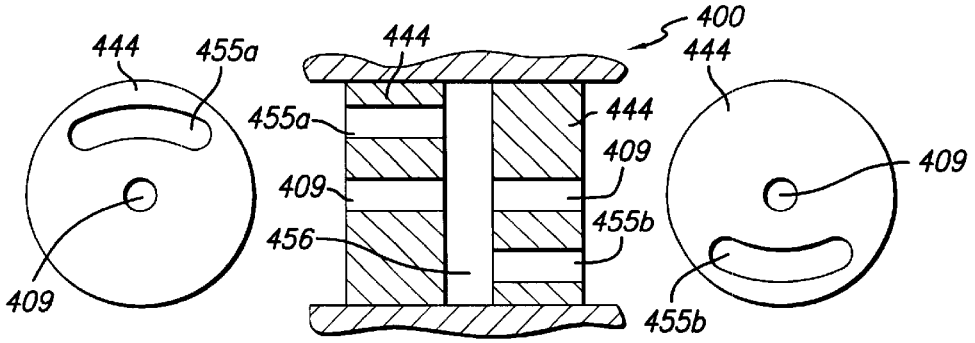
FIG. 15*a* is a front view of a coupled cavity circuit (e.g., a coupled cavity TWT amplifier or an integral polepiece RF amplification tube) according to another embodiment of the present invention.
FIG. 15*b* is a side cross-sectional view of the interior of the circuit of FIG. 15*a;*
FIG. 15*c* is a back view of the circuit of FIGS. 15*a* and 15*b;*

Referring now to FIGS. 15*a–c,* a coupled cavity circuit 400 according to another embodiment of the present invention is shown. The circuit 400 comprises a cavity 456 interposed between two circular polepieces 444. Each of the polepieces 444 contains a kidney shaped iris 455*a* or 455*b*. An electron beam tunnel 409 is also positioned within the circuit 400. The geometries of the iris 455*a–b* (e.g., the narrowness of the iris), the cavity 456, the beam tunnel 409, and the polepieces 444 (e.g., the thickness of the wall of the polepieces) should produce the desired electrical condition or the desired inductive/capacitive effect. In this embodiment, the desired inductive/capacitive effect is to cause the circuit to induce passband mode inversion without requiring the excessive iris length, such as illustrated in FIG. 3*c* for the prior art. Thus, there is no severing of the magnetic flux from the periodic permanent magnet (PPM) focusing fields. Accordingly, a preferred embodiment of an inverted slot mode circuit is shown. In addition, this circuit embodiment is a staggered slot circuit because iris 455*a* is located on the top of the circuit 400 and iris 455*b* is located on the bottom of the circuit 400.

Figures 16A, 16B, 16C:
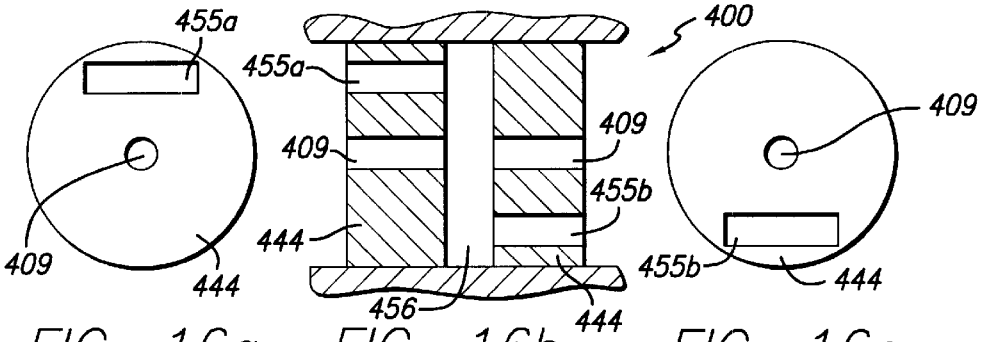
FIGS. 16*a,* 16*b,* and 16*c* are views of a first alternative embodiment of the circuit shown in FIGS. 15*a,* 15*b,* and 15*c;*

FIGS. 16*a–c* show a second embodiment of the coupled cavity circuit 400 shown in FIGS. 15*a–c*. In this embodiment, the circuit 400 comprises a cavity 456 interposed between two circular polepieces 444. Each of the polepieces 444 now contains a rectangular shaped iris 455*a* or 455*b*. An electron beam tunnel 409 is also positioned within the circuit 400. The geometries of the iris 455*a–b* (e.g., the narrowness of the iris), the cavity 456, the beam tunnel 409, and the polepieces 444 (e.g., the thickness of the wall of the polepieces) should produce the desired inductive/capacitive effect that is similar to the effect shown in FIGS. 15*a–c*. Accordingly, this circuit 400 is an alternative embodiment of the inverted slot mode circuit shown in FIGS. 11*a–c*. In addition, this embodiment is a staggered slot circuit because iris 455*a* is located on the top of the circuit 400 and iris 455*b* is located on the bottom of the circuit 400.

Figures 17A, 17B, 17C:
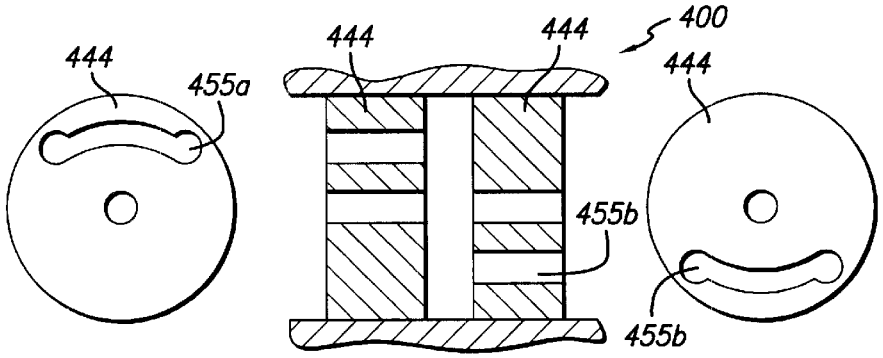
FIGS. 17*a,* 17*b,* and 17*c* are views of a second alternative embodiment of the circuit shown in FIGS. 15*a,* 15*b,* and 15*c;*

FIGS. 17*a–c* show a third embodiment of the coupled cavity circuit 400. In this embodiment, each of the circular polepieces 444 contains a flared, kidney-shaped iris 455*a* or 455*b*.

Figures 18A, 18B, 18C:
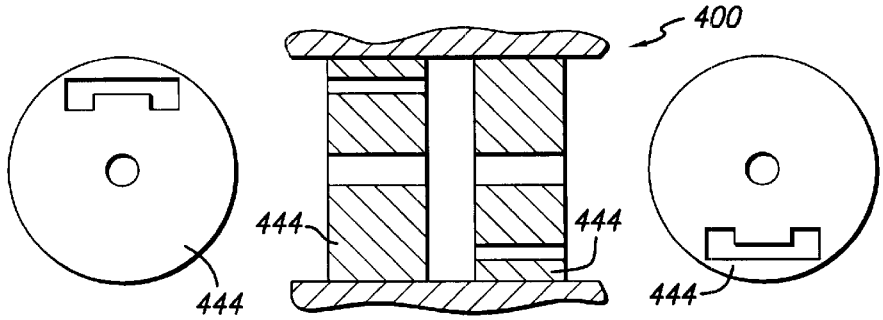
FIGS. 18*a,* 18*b,* and 18*c* are views of a third alternative embodiment of the circuit shown in FIGS. 15*a,* 15*b,* and 15*c;*

FIGS. 18*c* show a fourth embodiment of the coupled cavity circuit 400. In this embodiment, each of the circular polepieces 444 contains a flared, rectangular iris 455*a* or 455*b*.

Figures 19A, 19B, 19C:
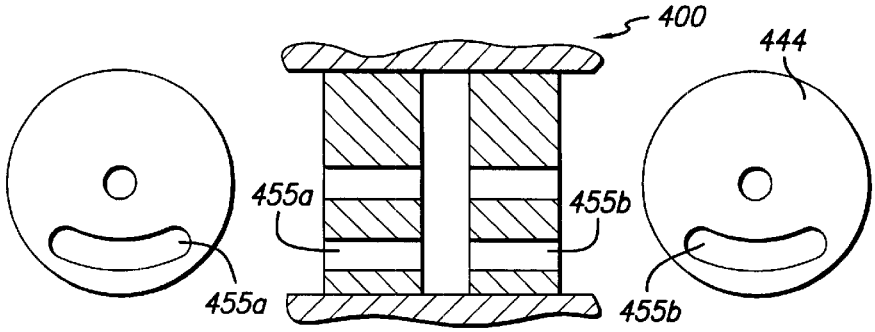
FIGS. 19*a,* 19*b,* and 19*c* are views of a fourth alternative embodiment of the circuit shown in FIGS. 15*a,* 15*b,* and 15*c;*

FIGS. 19*a–c* show a fifth embodiment of the coupled cavity circuit 400. In this embodiment, the circuit 400 is an in-line slot circuit because the kidney shaped irises 455*a* and 455*b* are located on the bottom of the circuit 400. An in-line slot circuit can also have an embodiment that has both of irises located on the top of the circuit 400.

Figures 20A, 20B, 20C:
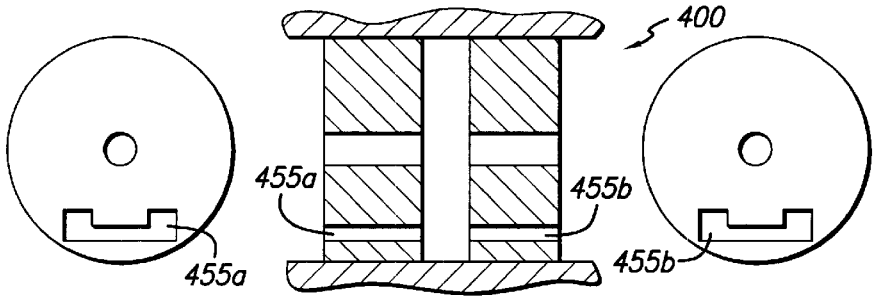
FIGS. 20*a,* 20*b,* and 20*c* are views of a fifth alternative embodiment of the circuit shown in FIGS. 15*a,* 15*b,* and 15*c;*

FIGS. 20*a–c* show a sixth embodiment of the coupled cavity circuit 400. This embodiment shows an in-line slot circuit having flared rectangular irises 455*a* and 455*b*.

Figures 21A, 21B, 21C:
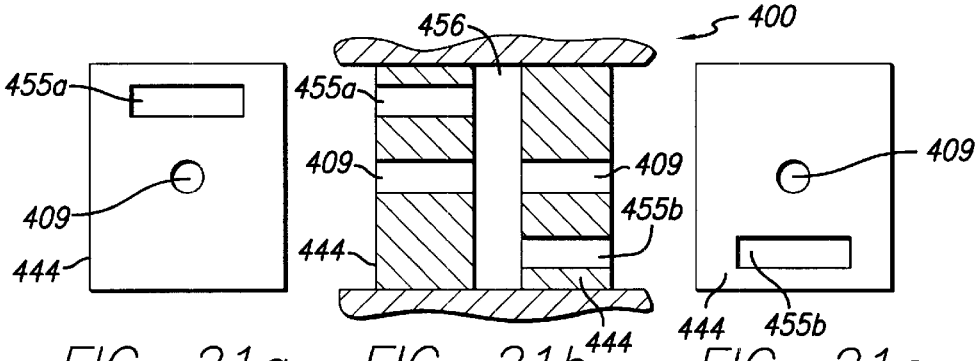
FIGS. 21*a,* 21*b,* and 21*c* are views of a sixth alternative embodiment of the circuit shown in FIGS. 15*a,* 15*b,* and 15*c;*

FIGS. 21*a–c* show a seventh embodiment of the coupled cavity circuit 400. In this embodiment, the circuit 400 comprises a cavity 456 that is now interposed between two rectangular polepieces 444. Each of the polepieces 444 contains a rectangular shaped iris 455*a* or 455*b*. An electron beam tunnel 409 is also positioned within the circuit 400. The geometries of the iris 455*a–b* (e.g., the narrowness of the iris), the cavity 456, the beam tunnel 409, and the polepieces 444 (e.g., the thickness of the wall of the polepieces) should produce the desired inductive/capacitive effect that is similar to the effect shown in FIGS. 15*a–c*. Accordingly, this circuit 400 is another alternative inverted slot mode circuit embodiment. In addition, this embodiment is a staggered slot circuit embodiment because iris 455*a* is located on the top of the circuit 400 and iris 455*b* is located on the bottom of the circuit 400.

Figures 22A, 22B, 22C:
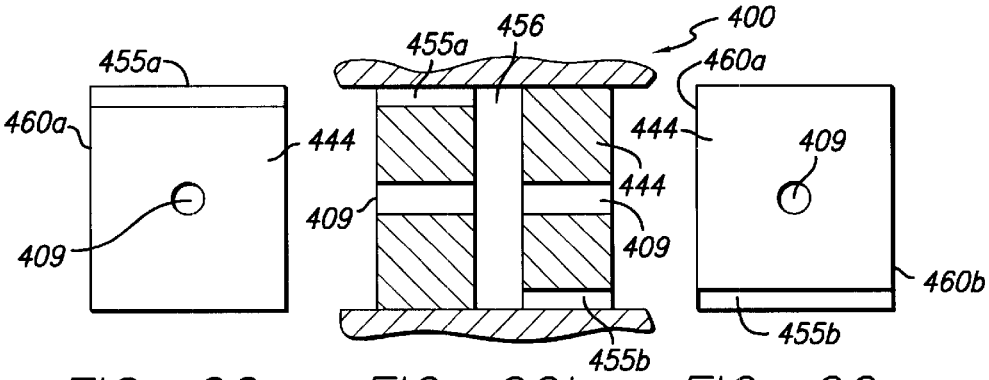
FIGS. 22*a,* 22*b,* and 22*c* are views of a seventh alternative embodiment of the circuit shown in FIGS. 15*a,* 15*b,* and 15*c;*

FIGS. 22*a–c* show an eighth embodiment of the coupled cavity circuit 400. In this embodiment, the circuit 400 comprises a cavity 456 that is interposed between two rectangular polepieces 444. Each of the polepieces 444 has a right side 460*a* and a left side 460*b*. Each of the polepieces 444 also has an iris 455*a* or 455*b* that is interposed between right side 460*a* and lift side 460*b* An electron beam tunnel 409 is also positioned within the circuit 400. The geometries of the iris 455*a–b* (e.g., the narrowness of the iris), the cavity 456, the beam tunnel 409, and the polepieces 444 (e.g., the thickness of the wall of the polepieces) should produce the desired inductive/capacitive effect that is similar to the effect shown in FIGS. 15*a–c*. Accordingly, this circuit 400 is another embodiment of the inverted slot mode circuit. In addition, this embodiment is a staggered slot circuit embodiment because iris 455*a* is located on the top of the circuit 400 and iris 455*b* is located on the bottom of the circuit 400.

Figures 23A, 23B, 23C:
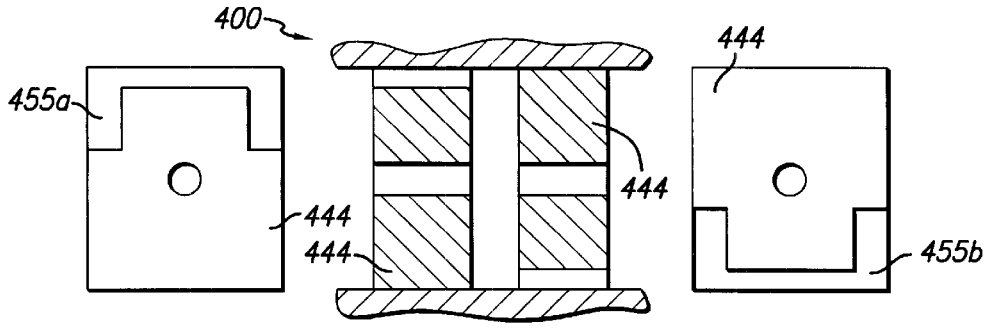
FIGS. 23*a,* 23*b,* and 23*c* are views of a eighth alternative embodiment of the circuit shown in FIGS. 15*a,* 15*b,* and 15*c;*
Figures 24A, 24B, 24C:
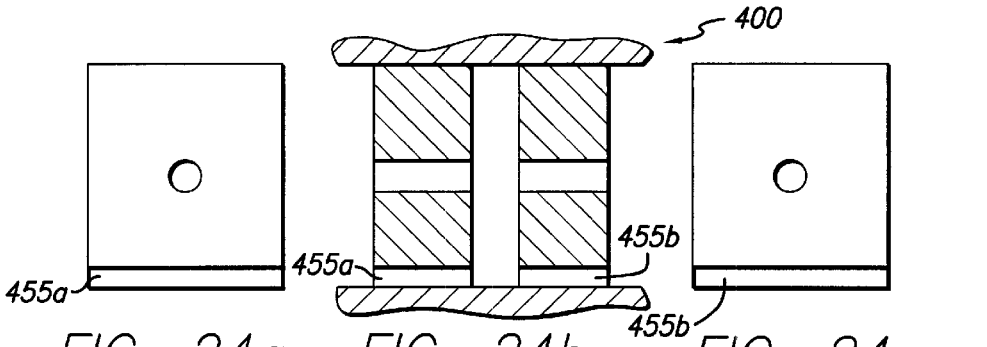
FIGS. 24*a,* 24*b,* and 24*c* are views of a ninth alternative embodiment of the circuit shown in FIGS. 15*a,* 15*b,* and 15*c;*
Figures 25A, 25B, 25C:
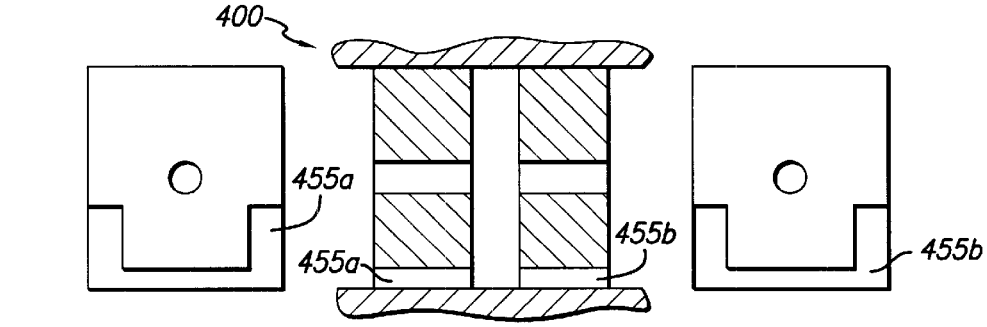
FIGS. 25*a,* 25*b,* and 25*c* are views of a tenth alternative embodiment of the circuit shown in FIGS. 15*a,* 15*b,* and 15*c;*

FIGS. 23*a–c* show a ninth embodiment of the coupled cavity circuit 400. In this embodiment, each of the polepieces 444 contains a flared side-to-side iris 455*a* or 455*b*.

FIGS. 24*a–c* and FIGS. 25*a–c* respectively show tenth and eleventh embodiments of the coupled cavity circuit 400. These two embodiments are similar to those shown in FIGS. 21*a–c* and FIGS. 22*a–c* with the exception that the embodiments herein contain irises 455*a–b,* which are located on the bottom of the circuit 400 (i.e., these embodiments are, thus, in-line slot circuits).

Figures 26A, 26B, 26C:
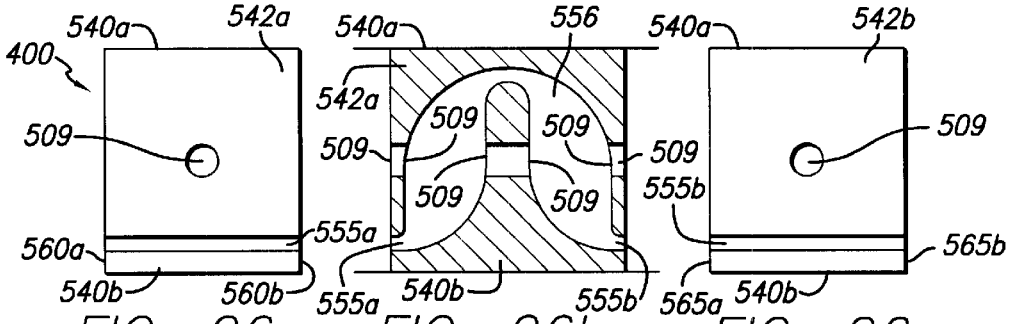
FIGS. 26*a,* 26*b,* and 26*c* are views of a eleventh alternative embodiment of the circuit shown in FIGS. 15*a,* 15*b,* and 15*c;*

FIGS. 26*a–c* show a twelfth embodiment of the coupled cavity circuit 400. In this embodiment, the circuit 400 now comprises a non-uniform channel 556 that is interposed between an arch-type folded waveguide 540*a* and a base waveguide 540*b*. The arch-type folded waveguide 540*a* contains a front face 542*a* and a back face 542*b*. The front face 542*a* has a right side 560*a* and a left side 560*b*. An iris 555*a* is positioned between right side 560*a* and left side 560*b* of the front face 542*a*. Similarly, the back face 542*b* has a right side 565*a* and a left side 565*b* and an iris 555*b* is positioned between right side 565*a* and 565*b* of the back face 542*b*. An electron beam tunnel 509 is also positioned within the circuit 400. The geometries of the iris 555*a–b* (e.g., the narrowness of the iris), the channel 556, the beam tunnel 509, and the waveguides 540*a–b* (e.g., the thickness of the wall of the waveguides) should produce the desired inductive/capacitive effect that is similar to the effect shown in FIGS. 15*a–c*.

In addition to the various embodiments shown above, the present invention can be utilized with one or more of the electron beam focusing schemes used in the art today, such as: 1) Periodic Permanent Magnet (PPM) focusing where the iron polepieces extend directly through to the electron beam tunnel; 2) PPM focusing where the iron polepieces are spaced from the electron beam tunnel; 3) continuous permanent magnet focusing; and 4) solenoid focusing. FIGS. 12*a–b* illustrate an example of the first type of focusing scheme (referred to as an integral polepiece structure) where the iron polepieces extended directly through to the electron beam tunnel. An example of the second type of focusing scheme, where the iron polepieces are spaced from the electron beam tunnel, is referred to hereinafter as a standard (or slip-on) polepiece stack and is shown in FIG. 27.

Figure 27:
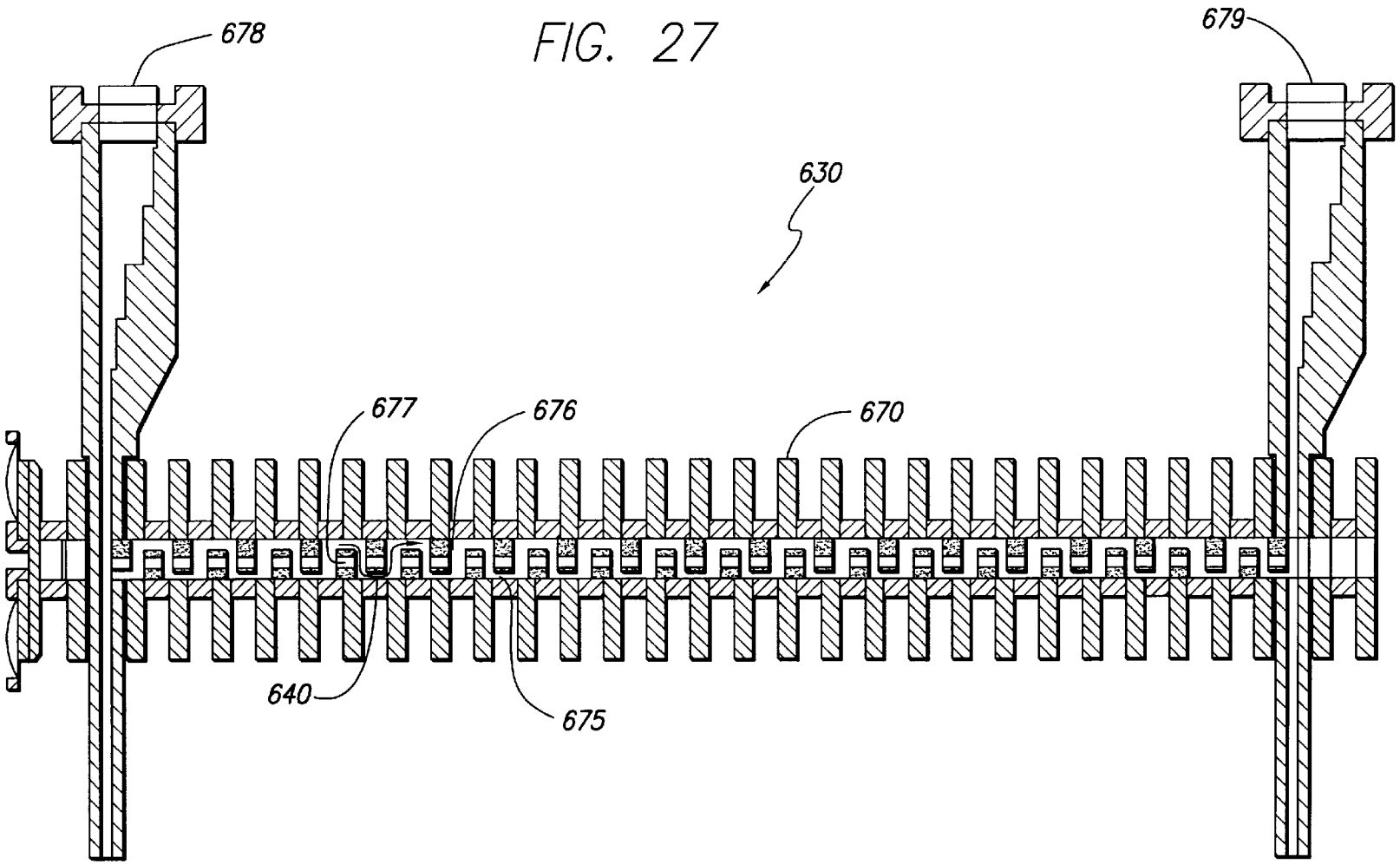
FIG. 27 illustrates a side sectional view of a coupled cavity TWT amplifier with a standard PPM polepiece stack that utilizes an iris according to an embodiment of the present invention.

FIG. 27 illustrates a side sectional view of a coupled cavity TWT 630 with a standard polepiece stack that utilizes an iris according to an embodiment of the present invention. An RF input 678 and a RF output 679 are shown along with a PPM polepiece stack 670 that is spaced from an electron beam tunnel 677. The meandering RF path 640 travels through the tuned cavities 676 that are linked by the irises 675. The irises 675 are shaped according to an embodiment of the present invention (e.g., as illustrated in FIG. 11). The ends of the tuned cavities 676, near the iris, may also be shaped according to an embodiment of the present invention to facilitate optimal RF propagation, as known in the art. For the TWT 630, the irises 675 and the tuned cavities 676 may be formed as part of a pure copper circuit that is inserted into an assembly that includes the PPM polepiece stack 670.

Using the standard polepiece stack as in FIG. 27 to generate the magnetic field, rather than the integral polepiece structure as in FIGS. 12*a–b,* allows the development of stronger magnetic field levels and the elimination of transverse fields in the electron beam tunnel 677. Furthermore, the standard polepiece stack of FIG. 27 reduces the number of incipient stopbands that result from machining laminated blocks to fabricate the coupled cavity circuit as with the integral polepiece structure of FIGS. 12*a–b*. In designing a lightweight, high-frequency amplifier, the integral polepiece structure may be preferred for low voltage applications while the standard polepiece stack may be preferred for high power applications.

An embodiment of the present invention can also be utilized in conjunction with a klystron. As known in the art, notches can couple a portion of the cavities in a klystron. The notches can be shaped according to an embodiment of the present invention, thus allowing the cavities to operate as an extended interaction output circuit for improved bandwidth.

Figure 28:
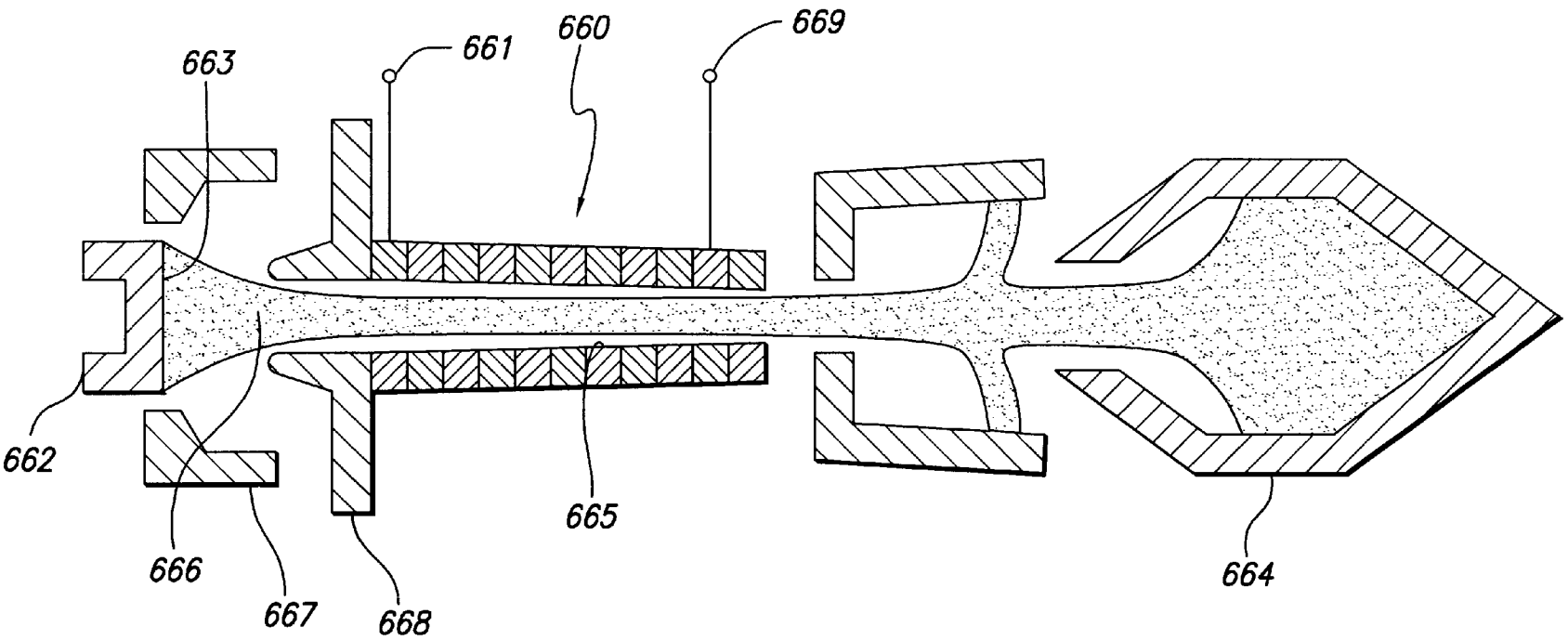
FIG. 28 illustrates a side sectional view of a coupled cavity microwave amplification tube assembled to an electron gun and a collector.

To put the coupled cavity circuit into use, the coupled cavity circuit is placed within an amplification tube, usually along with a number of other similar coupled cavity circuits, to form a complete amplifier assembly. The amplification tube 660, as shown in FIG. 28, can then be assembled to an electron gun 662 and an electron beam collector 664. The electron gun 662 has a cathode 663 that emits electrons. The electrons are focused into an electron beam 666 by focusing electrodes 667 and an anode 668. A magnetic field provided along the electron beam tunnel 665 maintains the focus of the electron beam 666 within the tube 660. The collector 664 receives and dissipates the electrons after they exit the tube 660. A RF input terminal 661 and a RF output terminal 69 are provided for amplification of a RF signal.

Figure 30:
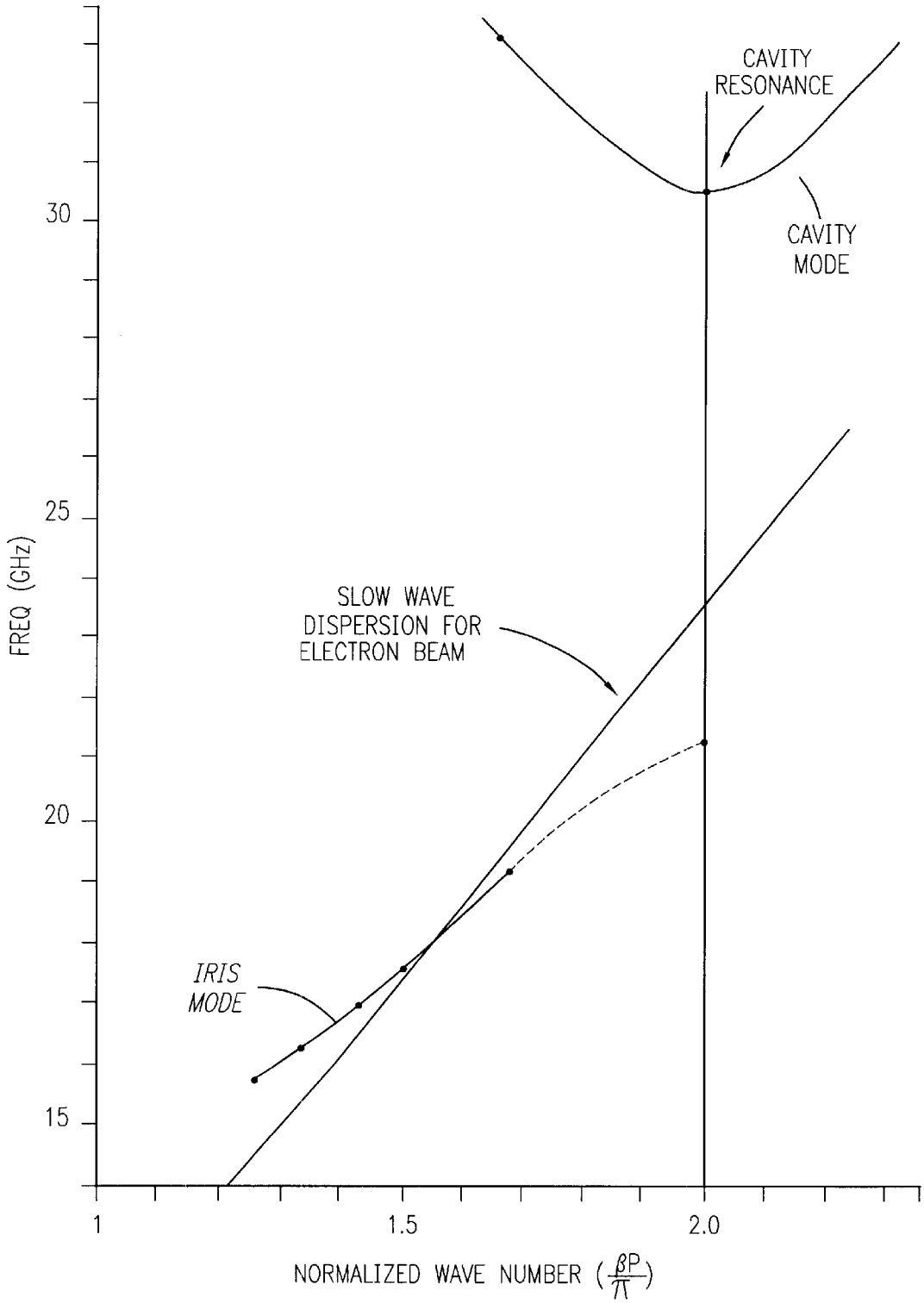
FIG. 30 is a graph plotting the frequency versus the normalized wave number for a coupled cavity circuit that utilizes an iris according to an embodiment of the present invention.

FIGS. 29 and 30 are graphs that provide performance data for a coupled cavity circuit in accordance with an embodiment of the present invention. FIG. 29 plots the axial component of the electric field in the coupled cavity circuit gap for a resonance frequency at 30 GHz. The equal amplitudes that correspond to a $2\pi$ phase shift between cavities identify this as a cavity resonance. This cavity resonance usually must be lossed out when it appears in the same passband as the operating frequencies. In this case, the circuit operates in the Ku frequency band using the iris mode passband. Thus, due to the iris producing passband mode inversion, the operating frequencies are far below the cavity passband that contains the cavity resonance and no lossy material is required inside the coupled cavity circuit.

FIG. 30 plots frequency as a function of the normalized wave number (wave number $\beta$ times the circuit period P divided by $\pi$). The cavity mode passband and iris mode passband are plotted along with the slow wave dispersion for an electron beam. The plot shows how the slow wave circuit dispersion allows a broadband circuit to avoid drive-induced cavity resonances. As the electron beam loses energy during interaction, the phase velocity of the slow space charge waves decreases and the slope of the iris slow wave mode dispersion line drops. In a convention non-inverted slot mode circuit, the line would approach the cavity resonance. For this invention, the line moves away from the cavity resonance. Furthermore, the plot shows that an iris (according to an embodiment of the present invention) can be utilized not only for the forward wave, but also for the backward wave, as known in the art.

Accordingly, various embodiments of an inverted slot mode, coupled cavity circuit that interacts an electron beam with the second passband (the cavity passband) of an RF signal have been shown. Having thus described various embodiments of the coupled cavity circuit, it should be apparent to those skilled in the art that certain advantages of the within system have been achieved. It should also be appreciated that various modifications, adaptations, and alternative embodiments thereof may be made within the scope and spirit of the present invention. For example, a rectangular waveguide shape has been illustrated to show an embodiment of the present invention, but it should be apparent that the inventive concepts described above would be equally applicable to circular waveguides or other shapes as known in the art. The invention is further defined by the following claims.

What is claimed is:

1. A microwave electron tube, comprising:

an electron gun for emitting an electron beam having a predetermined voltage;

a collector spaced from said electron gun, said collector collecting electrons of said electron beam emitted from said electron gun;

an interaction structure defining an electromagnetic path along which an applied electromagnetic signal interacts with said electron beam, said interaction structure further comprising a plurality of cavity walls and a plurality of permanent magnets, said cavity walls each having an aligned opening providing an electron beam tunnel extending between said electron gun and said collector, said electron beam tunnel defining an electron beam path for said electron beam, said magnets providing a magnetic flux path to said electron beam tunnel, said electromagnetic signal having a first passband and a second passband, said first passband having a upper bandedge, said second passband having a first, second and third space harmonics and a lower bandedge;

wherein, said interaction structure further includes respective cavities defined therein interconnected to provide a coupled cavity circuit, said cavity walls separating adjacent ones of said cavities, said cavity walls each further having an iris for coupling said electromagnetic signal therethrough;

wherein, said iris and said cavity walls are dimensioned to allow said interaction structure to exhibit an inverted slot mode, said inverted slot mode comprising a cavity resonant frequency that is substantially larger than a corresponding iris cutoff frequency and wherein said cavity resonant frequency is associated with said lower bandedge of said second passband, and said iris cutoff frequency is associated with said upper bandedge of said first passband; and wherein, said predetermined voltage of said electron beam is selected to allow said electron beam to interact with said third space harmonic of said second passband.

2. The microwave electron tube of claim 1, wherein said predetermined voltage of said electron beam is further selected to allow said electron beam to interact near said upper bandedge of said first passband.

3. The microwave electron tube of claim 1, wherein said interaction structure allows a range of acceptable voltages for said electron beam to interact with said third space harmonic of said second passband.

4. The microwave electron tube of claim 3, wherein said electron beam further comprises a predetermined current level and wherein said range of acceptable voltages decreases as said predetermined current level increases.

5. The microwave electron tube of claim 1, wherein said iris and said cavity walls are dimensioned by using a geometric formula and wherein said geometric formula comprises:

$$\left(\frac{\pi^2 R^2 \ln(R/A)}{12L^2} + \frac{\pi R^2 Wm}{3GLT}\right) < 1$$

wherein A represents a radius of said beam tunnel, L represents an effective length of said iris, W represents a height of said iris, R represents a radius of one of said cavities that is coupled to said iris, T represents a thickness of one of said cavity walls that is associated with said iris, G represents a gap between two of said cavity walls, and m represents a friction of a total current circulating in one of said cavities of said coupled circuit that intercepts only one iris.

6. The microwave electron tube of claim 1, wherein said iris comprises an iris capacitance and an iris inductance and wherein said iris capacitance and iris inductance are selected to exhibit said inverted slot mode.

7. The microwave electron tube of claim 6, wherein each of said cavities comprises a cavity capacitance and a cavity inductance and wherein said cavity capacitance and said cavity inductance are selected to exhibit said inverted slot mode.

8. The microwave electron tube of claim 7, wherein said iris capacitance, said iris inductance, said cavity capacitance, and said cavity inductance are selected using an electrical circuit formula and wherein said electrical circuit formula comprises:

$$\frac{L_C C_C}{L_S C_S} + \frac{2mC_C}{C_S} < 1$$

wherein $L_s$ represents an inductance value of said iris, $C_s$ represents a capacitance value of said iris, $L_c$ represents an inductance value of one of said cavities that is coupled to said iris, $C_c$ represents a capacitance value of said cavity, and m represents a friction of a total current circulating in one of said cavities of said cavity circuit that intercepts only one iris.

9. The microwave electron tube of claim 1, wherein impedances resulting from the interaction between said electron beam and said applied electromagnetic signal are matched.

10. The microwave electron tube of claim 1, wherein said impedances comprise interactions of said electron beam with said second passband and both parts of a stopband that are located between said first and second passbands.

11. A method of microwave amplification, comprising:

providing an electron beam;

focusing said electron beam by using a plurality of permanent magnets;

providing an applied microwave signal having a first passband and a second passband, said first passband having an upper bandedge, said second passband having first, second and third space harmonics and a lower bandedge;

exhibiting a cavity resonant frequency that is substantially larger than a corresponding iris cutoff frequency, wherein said cavity resonant frequency is associated with said lower bandedge of said second passband, and said iris cutoff frequency is associated with said upper bandedge of said first passband; and interacting said electron beam with said third space harmonic of said second passband.

12. The method of microwave amplification of claim 11, wherein said interacting step further comprises matching impedances resulting from said electron beam interacting with said second passband and a stopband that are located between said first and second passbands.

13. The method of microwave amplification of claim 11, wherein said exhibiting step further comprises confirming said cavity resonant frequency is substantially larger than said corresponding iris cutoff frequency by using computer simulation codes.

14. A microwave electron tube, comprising:

an electron gun for emitting an electron beam;

a collector spaced from said electron gun, said collector collecting electrons of said electron beam emitted from said electron gun;

an interaction structure defining an electromagnetic path along which an applied electromagnetic signal interacts with said electron beam, said interaction structure further comprising a plurality of cavity walls and a plurality of magnets, said cavity walls each having an aligned opening providing an electron beam tunnel extending between said electron gun and said collector, said electron beam tunnel defining an electron beam path for said electron beam, said magnets providing a magnetic flux path to said electron beam tunnel;

wherein, said interaction structure further includes respective cavities defined therein interconnected to provide a coupled cavity circuit, said cavity walls separating adjacent ones of said cavities, said cavity walls each further having an iris for coupling said electromagnetic signal therethrough; and wherein, said iris and said cavity walls are dimensioned using a geometric formula to allow said interaction structure to exhibit an inverted slot mode, said inverted slot mode comprising a cavity resonant frequency that is substantially larger than a corresponding iris cutoff frequency, said geometric formula comprising:

$$\left(\frac{\pi^2 R^2 \ln(R/A)}{12L^2} + \frac{\pi R^2 Wm}{3GLT}\right) < 1$$

wherein A represents a radius of said beam tunnel, L represents an effective length of said iris, W represents a height of said iris, R represents a radius of one of said cavities that is coupled to said iris, T represents a thickness of one of said cavity walls that is associated with said iris, G represents a gap between two of said cavity walls, and m represents a friction of a total current circulating in one of said cavities of said coupled circuit that intercepts only one iris.

15. The microwave electron tube of claim 14, wherein said plurality of magnets comprise a plurality of permanent magnets.

16. The microwave electron tube of claim 14, wherein said electromagnetic signal comprises a first passband and a second passband, said first passband having a upper bandedge, and said second passband having a first, second and third space harmonics and a lower bandedge; wherein said cavity resonant frequency is associated with said lower bandedge and said iris cutoff frequency is associated with said upper bandedge; and wherein said electron beam interacts with said third space harmonic of said second passband.

17. A microwave electron tube, comprising:

an electron gun for emitting an electron beam;

a collector spaced from said electron gun, said collector collecting electrons of said electron beam emitted from said electron gun;

an interaction structure defining an electromagnetic path along which an applied electromagnetic signal interacts with said electron beam, said interaction structure further comprising a plurality of cavity walls and a plurality of magnets, said cavity walls each having an aligned opening providing an electron beam tunnel extending between said electron gun and said collector, said electron beam tunnel defining an electron beam path for said electron beam, said magnets providing a magnetic flux path to said electron beam tunnel;

wherein, said interaction structure further includes respective cavities defined therein interconnected to provide a coupled cavity circuit, said cavity walls separating adjacent ones of said cavities, said cavity walls each further having an iris for coupling said electromagnetic signal therethrough;

wherein, said iris comprises an iris capacitance and an iris inductance and each of said cavity walls comprises a cavity capacitance and a cavity inductance; and wherein, said iris capacitance, said iris inductance, said cavity capacitance, and said cavity inductance are selected to exhibit an inverted slot mode, and said inverted slot mode comprising a cavity resonant frequency that is substantially larger than a corresponding iris cutoff frequency.

18. The microwave electron tube of claim 17, wherein said iris capacitance, said iris inductance, said cavity capacitance, and said cavity inductance are selected using an electrical circuit formula and wherein said electrical circuit formula comprises:

$$\frac{L_C C_C}{L_S C_S} + \frac{2mC_C}{C_S} < 1$$

wherein $L_s$ represents an inductance value of said iris, $C_s$ represents a capacitance value of said iris, $L_c$ represents an inductance value of one of said cavities that is coupled to said iris, $C_c$ represents a capacitance value of said cavity, and m represents a friction of a total current circulating in one of said cavities of said coupled circuit that intercepts only one iris.

19. The microwave electron tube of claim 17, wherein said plurality of magnets comprise a plurality of permanent magnets.

20. The microwave electron tube of claim 17, wherein said electromagnetic signal comprises a first passband and a second passband, said first passband having a upper bandedge, said second passband having a first, second and third space harmonics and a lower bandedge; wherein said cavity resonant frequency is associated with said lower bandedge, and said iris cutoff frequency is associated with said upper bandedge; and wherein said electron beam interacts with said third space harmonic of said second passband.

* * * * *